US008042532B2

(12) United States Patent
Kaneko et al.

(10) Patent No.: US 8,042,532 B2
(45) Date of Patent: Oct. 25, 2011

(54) HEAT-COOKING APPARATUS

(75) Inventors: Fuminori Kaneko, Habikino (JP); Yoshikazu Yamamoto, Kadoma (JP); Yoshikazu Kitaguchi, Habikino (JP); Masato Nakatani, Kashiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 1423 days.

(21) Appl. No.: 10/584,750

(22) PCT Filed: Dec. 16, 2004

(86) PCT No.: PCT/JP2004/018807

§ 371 (c)(1),
(2), (4) Date: Jun. 27, 2006

(87) PCT Pub. No.: WO2005/066545

PCT Pub. Date: Jul. 21, 2005

(65) Prior Publication Data

US 2007/0163567 A1 Jul. 19, 2007

(30) Foreign Application Priority Data

Jan. 7, 2004 (JP) ..... 2004-002101

(51) Int. Cl.
*F24C 15/32* (2006.01)
*A21B 1/08* (2006.01)

(52) U.S. Cl. ..... 126/21 A; 126/20; 126/190; 126/198; 126/287; 99/468; 99/474; 99/476; 219/391; 219/400

(58) Field of Classification Search ..... 126/20, 126/21 A, 198, 287, 190; 219/400, 391; 99/474, 468, 476
See application file for complete search history.

(56) References Cited

U.S. PATENT DOCUMENTS 2,739,584 A * 3/1956 Hupp ..... 126/21 R
(Continued)

FOREIGN PATENT DOCUMENTS

JP 55-53895 A 4/1980
(Continued)

OTHER PUBLICATIONS

Microfilm of the specification and drawings annexed to the request of Japanese Utility Model Application No. 57679/1985 (Laid-open No. 172905/1986) (Hitachi Netsukigu Kabushiki Kaisha), Oct. 27, 1986, Full Text (Family: none).

(Continued)

*Primary Examiner* — Steven B. McAllister
*Assistant Examiner* — Avinash Savani
(74) *Attorney, Agent, or Firm* — Birch, Stewart, Kolasch & Birch, LLP

(57) ABSTRACT

A heat-cooking apparatus includes blowing means (100) that blows cooling air to an opening (20*a*) of a heating chamber (20) when a door (11) is opened after steam is supplied to the heating chamber (20) for preparatory operation before heat-cooking or for heat-cooking itself. More specifically, after steam is supplied to the heating chamber (20), when the door (11) is opened, the blowing means (100) drives a conventionally existing cooling fan (101) to suck in cooling air from outside the apparatus, and deflects the cooling air toward the opening (20*a*) of the heating chamber (20) with a decoration box (102) so that the cooling air is blown to the opening (20*a*) so as to pass sideways substantially across it. Thus, the cooling air mixes with high-temperature steam that tends to overflow frontward as soon as the door (11) is opened, and thereby lowers the temperature of the steam. This surely prevents the user from being hurt, as by being burnt, with the overflowing steam. Thus, without use of special exhausting means, it is possible to open the door (11) while ensuring the safety of the user even immediately after a heating medium (for example, steam) is supplied to the heating chamber (20).

23 Claims, 14 Drawing Sheets

U.S. PATENT DOCUMENTS

| | | | | |
|---|---|---|---|---|
| 3,681,557 | A * | 8/1972 | Suzuki et al. | 219/740 |
| 4,898,319 | A * | 2/1990 | Williams | 228/219 |
| 5,532,456 | A * | 7/1996 | Smith et al. | 219/400 |
| 5,694,835 | A * | 12/1997 | Mangina | 99/468 |
| 6,414,287 | B2 * | 7/2002 | Han et al. | 219/715 |
| 6,497,907 | B2 * | 12/2002 | Hofer | 426/233 |
| 6,561,180 | B1 * | 5/2003 | Austin et al. | 126/198 |
| 6,874,331 | B2 * | 4/2005 | Chandler et al. | 62/256 |
| 2002/0179588 | A1 * | 12/2002 | Lubrina et al. | 219/400 |

FOREIGN PATENT DOCUMENTS

| | | | |
|---|---|---|---|
| JP | 56-003307 | A | 1/1981 |
| JP | 56-068806 | A | 6/1981 |
| JP | 57-9604 | Y2 | 2/1982 |
| JP | 57-19529 | A | 2/1982 |
| JP | 61-213513 | A | 9/1986 |
| JP | 61-172902 | U | 10/1986 |
| JP | 61-172905 | U | 10/1986 |
| JP | 1-195692 | A | 8/1989 |
| JP | 6-10707 | U | 2/1994 |
| JP | 8-128639 | A | 5/1996 |
| JP | 9-229377 | A | 9/1997 |

OTHER PUBLICATIONS

Microfilm of the specification and drawings annexed to the request of Japanese Utility Model Application No. 57680/1985 (Laid-open No. 172902/1986) (Hitachi Netsukigu Kabushiki Kaisha), Oct.27 , 1986, Full text (Family: none).

CD-ROM of the specification and drawings annexed to the request of Japanese Utility Model Application No. 3036/1992 (Laid-open No. 10707/1994) (Tiger Co., Ltd.), Feb. 10, 1994, Full text (Family: none).

* cited by examiner

HEAT-COOKING APPARATUS

TECHNICAL FIELD

The present invention relates to a heat-cooking apparatus that heats and thereby cooks an article-to-be-heated placed inside a heating chamber by means of a heating medium such as steam or hot air.

BACKGROUND ART

There have conventionally been proposed various heat-cooking apparatuses that heat and thereby cook an article-to-be-heated by means of a heating medium. With a heat-cooking apparatus of this type, on completion of heat-cooking, if the user, wanting to take the heated article out of the heating chamber, immediately opens the door provided at the front of the heating chamber, the heating medium remaining inside the heating chamber overflows frontward out of it, and this may cause the user to be hurt, as by being burnt with the heating medium.

To prevent this inconvenience, for example, in the steam convection oven disclosed in Patent Document 1 listed below, when the user is detected as starting to open the door, before the door is opened, the heating medium inside the heating chamber is forcedly exhausted. More specifically, a push switch is provided at the handle of the door to the heating chamber so that, when the user, wanting to open the door, grips the handle, the push switch is turned on, signaling the detection of the user starting to open the door. As soon as the user is thus detected as starting to open the door, the heating medium stops being supplied to the heating chamber, and the heating medium inside the heating chamber is forcedly exhausted by exhausting means.

Patent Document 1: JP-A-H9-89260

DISCLOSURE OF THE INVENTION

Problems to be Solved by the Invention

Disadvantageously, however, with the configuration according to Patent Document 1 mentioned above, since the forced exhaustion of the heating medium inside the heating chamber requires a certain length of time, immediately after completion of heat-cooking, a certain amount of the heating medium inevitably remains inside the heating chamber. Thus, if the door is opened immediately after completion of heat-cooking, it is still highly likely that the heating medium inside overflows toward the user. Hence, it is still impossible to surely avoid hurting the user. In another configuration, before an article-to-be-heated is placed inside the heating chamber, the heating medium is previously supplied to the heating chamber in a circulating fashion so that the temperature of the heating medium is gradually raised. This makes it possible to start heat-cooking readily with the heating medium already at a high temperature. Disadvantageously, however, also with this configuration, the above inconvenience is equally likely to arise when the user opens the door to place the article-to-be-heated in the heating chamber.

To surely avoid these inconveniences, Patent Document 1 mentioned above also discloses a configuration where, after the user is detected as starting to open the door, the door is locked so that it cannot be opened for a predetermined length of time. Disadvantageously, however, with this configuration, for example, on completion of heat-cooking, the user cannot immediately take out the article-to-be-heated. This embarrasses the user, and hinders the following steps of food preparation (such as further processing and dishing-up of food).

These inconveniences can be overcome with a configuration involving exhausting means with high exhaustion efficiency. Disadvantageously, however, such a configuration, requiring large-scale exhausting means, makes the apparatus as a whole undesirably large and makes its electric power consumption undesirably high.

The present invention has been made to overcome the inconveniences discussed above, and an object of the present invention is to provide a heat-cooking apparatus that, despite requiring no special exhausting means, ensures the safety of the user even when the door to the heating chamber is opened immediately after the heating medium is supplied to the heating chamber and that thereby allows prompt transition to the following steps of food preparation.

Means for Solving the Problem (1) According to the present invention, a heat-cooking apparatus is provided with: a heating chamber having an opening through which an article-to-be-heated is put into and taken out of the heating chamber; a door for opening and closing the opening; and heating medium generating means for generating a heating medium. This heat-cooking apparatus heats and thereby cooks the article-to-be-heated placed inside the heating chamber by means of the heating medium. Here, the heat-cooking apparatus is further provided with: blowing means that blows cooling air to the opening when, after the heating medium is supplied to the heating chamber by the heating medium generating means, the door starts to be opened.

Immediately before heat-cooking an article-to-be-heated, through preparatory operation, the high-temperature heating medium supplied from the heating medium generating means may remain inside the heating chamber. On the other hand, after heat-cooking, the high-temperature heating medium used for the heat-cooking remains inside the heating chamber. Thus, if the door starts to be opened in these states (even though the heating medium inside the heating chamber is exhausted out of the apparatus by exhausting means), the heating medium inside the heating chamber tends to overflow toward the door, that is, frontward.

With the above-described configuration, however, no matter whether before or after heat-cooking, when the door starts to be opened after the heating medium is supplied to the heating chamber by the heating medium generating means, the blowing means blows cooling air to the opening of the heating chamber. Thus, the cooling air mixes with the high-temperature heating medium that tends to overflow frontward, and thereby lowers the temperature of the heating medium. This surely prevents the user from being hurt, as by being burnt, with the overflowing heating medium, and thus ensures the safety of the user. Moreover, as a result, the door can be opened, for example, immediately after completion of heat-cooking. This allows prompt transition to the following steps of food preparation (such as further processing and dishing-up of the article-to-be-heated taken out of the heating chamber).

The above-mentioned benefits of the present invention can be obtained without taking any special measures, for example, to increase the exhaustion efficiency with which the heating medium inside the heating chamber is exhausted, and hence without the need for large-scale exhausting means leading to an undesirably large size of the apparatus as a whole and unduly high electric power consumption by it.

(2) In the heat-cooking apparatus according to the present invention, the heating medium generating means may be steam generating means that generates steam as the heating medium.

Using as the heating medium the steam generated by the steam generating means makes it possible to adopt a method whereby the steam is blown directly onto the article-to-be-heated to heat it. This method, compared with one whereby the atmospheric temperature inside the heating chamber is raised by circulation of hot air to heat the article-to-be-heated, permits the entire article-to-be-heated to be heated quickly and evenly, and also allows various modes of cooking (warming, steaming, roasting, etc.) to be realized.

(3) In the heat-cooking apparatus according to the present invention, the opening may be provided in the front face of the heating chamber, the door may be pivotably hinged in a bottom part or top part of a casing for housing the heating chamber so that the door opens vertically (at the top or bottom end thereof) with respect to the opening, and the blowing means may blow the cooling air to the opening so that the cooling air passes the opening sideways.

When the door starts to be opened immediately after the heating medium is supplied to the heating chamber, the high-temperature heating medium inside the heating chamber tends to overflow frontward through an upper part of the opening. However, as a result of the blowing means blowing the cooling air to the opening so that the cooling air passes sideways (in the left/right direction) substantially across the opening, the temperature of the overflowing heating medium is lowered, and in addition the path along which the heating medium overflows frontward through an upper part of the opening is deviated in the direction in which the cooling air passes sideways. This prevents the heating medium from hitting the user standing in front of the apparatus, and thus helps realize an apparatus safer for the user to use.

(4) In the heat-cooking apparatus according to the present invention, the blowing means may blow the cooling air to the opening so that the cooling air passes an upper part of the opening sideways.

As described above, when the door starts to be opened immediately after the heating medium is supplied to the heating chamber, the high-temperature heating medium inside the heating chamber tends to overflow frontward through an upper part of the opening. However, as a result of the blowing means blowing the cooling air to the opening so that the cooling air passes sideways substantially across an upper part of the opening, the path along which the heating medium overflows can more efficiently be deviated in the sideways direction to ensure the safety of the user.

(5) In the heat-cooking apparatus according to the present invention, the blowing means may blow the cooling air to the opening so that the cooling air passes a part of the opening above half a vertical dimension thereof sideways.

With this configuration, the cooling air blown by the blowing means passes substantially across a part of the opening above half the vertical dimension thereof. Thus, with the minimum required amount of cooling air blown, the above-mentioned benefits can be obtained efficiently and surely.

(6) In the heat-cooking apparatus according to the present invention, the blowing means may have a cooling fan for cooling a power supply circuit board provided inside the apparatus, and may blow, as the cooling air, air sucked in from outside the apparatus by the cooling fan to the opening.

With this configuration, the heating medium overflowing through the opening can be cooled by use of the cooling fan for cooling the power supply circuit board originally provided inside the apparatus. This eliminates the need to separately provide cooling means dedicated to the cooling of the heating medium, and thus helps simplify the configuration of the apparatus and prevent it from becoming unduly large.

(7) In the heat-cooking apparatus according to the present invention, the blowing means may include deflecting means that deflects the air sucked in by the cooling fan so that the air is blown to the opening.

The air sucked in by the cooling fan is deflected by the deflecting means so as to be blown to the opening. This eliminates the need to pay special attention to where to arrange the cooling fan, and helps surely secure the path along which to supply the cooling air to be blown to the opening.

(8) In the heat-cooking apparatus according to the present invention, the door may have a multiple-glazed portion having a plurality of transparent glass plates arranged to face one another with a predetermined gap in between so that, when the door is closed, part of the multiple-glazed portion faces at least the opening, and the deflecting means may direct the air sucked in by the cooling fan toward a side of the multiple-glazed portion when the door is closed.

With this configuration, the deflecting means directs the air sucked in by the cooling fan to a side of the multiple-glazed portion when the door is closed. Thus, when the door starts to be opened, the cooling air can surely be blown to the opening so that the cooling air passes sideways substantially across the opening. Moreover, when the door is closed, the cooling air may be blown through the gap between the glass plates of the multiple-glazed portion. Thus, the door can be cooled even during heat-cooking, when the door remains closed.

(9) In the heat-cooking apparatus according to the present invention, the door may have a support base plate that has an area larger than the area of the multiple-glazed portion and so large as to cover the entire opening-side face of the heating chamber in the casing and that supports the multiple-glazed portion from the face thereof facing away from the opening when the door is closed, the support base plate may include an operation portion for setting the operation conditions of the apparatus, and the deflecting means may be built with a decoration box that is provided between the operation portion and the casing, at a side of the multiple-glazed portion when the door is closed.

In the apparatus configured to include a decoration box as described above, as a result of the deflecting means being built with the decoration box, the decoration box serves not only its original function (of keeping the apparatus neat-looking when the door is opened) but also the function of deflecting the cooling air to blow it to the opening. This helps secure the path along which to supply the cooling air to the opening, and also helps use the decoration box efficiently.

(10) In the heat-cooking apparatus according to the present invention, the door may have a support base plate that has an area larger than the area of the multiple-glazed portion and so large as to cover the entire opening-side face of the heating chamber in the casing and that supports the multiple-glazed portion from the face thereof facing away from the opening when the door is closed, the support base plate may include an operation portion for setting the operation conditions of the apparatus, and the deflecting means may be built with a protruding portion that protrudes from the casing along the surfaces of the multiple-glazed portion and of the support base plate when the door is closed.

With the above configuration, in the apparatus having a protruding portion formed so as to protrude from the casing along the surfaces of the multiple-glazed portion and of the support base plate when the door is closed, the protruding portion serves the function of deflecting the cooling air, and this helps secure the path along which to supply the cooling air to the opening.

(11) In the heat-cooking apparatus according to the present invention, the blowing means may blow the cooling air to the opening for a predetermined length of time after the door is opened after completion of heat-cooking inside the heating chamber.

This configuration can be realized, for example, by keeping the cooling fan rotating for a predetermined length of time after the door is opened after completion of heat-cooking. By letting, in this way, the blowing means blow the cooling air to the opening for a predetermined length of time after the door is opened after completion of heat-cooking, it is possible to eliminate unnecessary operation of the cooling air being blown even after the heating medium has been cooled, and thereby to prevent electric power from being unnecessarily consumed.

(12) In the heat-cooking apparatus according to the present invention, while the heating medium is being supplied to the heating chamber by the heating medium generating means, the blowing means blows the cooling air into the interior of the door in the closed state.

While the heating medium is being supplied to the heating chamber by the heating medium generating means, that is, during preparatory operation before heat-cooking or during heat-cooking itself, the high-temperature heating medium is present inside the heating chamber. With the above-described configuration, even while the heating medium is being supplied to the heating chamber, the door in the closed state is cooled with the cooling air. Thus, also during this period, it is possible to prevent the temperature of the door from being unduly raised by the high-temperature heating medium inside the heating chamber, and thereby to ensure the safety of the user.

Advantages of the Invention

According to the present invention, after the heating medium is supplied to the heating chamber, when the door starts to be opened, the cooling air blown by the blowing means mixes with the high-temperature heating medium that tends to overflow frontward through the opening of the heating chamber, and thereby lowers the temperature of the heating medium. Thus, the user is surely prevented from being hurt, as by being burnt, with the overflowing heating medium. Now that the safety of the user is ensured, the user can open the door, for example, immediately after heat-cooking to promptly proceed to the following steps of food preparation. Moreover, since no special measures need to be taken, for example, to increase the exhaustion efficiency with which the heating medium inside the heating chamber is exhausted before the door is opened, it is possible to do without large-scale exhausting means leading to an undesirably large size of the apparatus as a whole and unduly high electric power consumption by it.

LIST OF REFERENCE SYMBOLS

1 Steam Cooking Apparatus (Heat-Cooking Apparatus)
10 Cabinet (Casing)
11 Door
13 Operation Panel (Operation Portion)
20 Heating Chamber
20*a* Opening
40 Sub-Cavity (Steam Generating Means, Heating Medium Generating Means)
50 Steam Generating Device (Steam Generating Means, Heating Medium Generating Means)
90 Article-To-Be-Heated
100 Blowing Means
101 Cooling Fan
102 Decoration Box (Deflecting Means)
103 Power Supply Circuit Board
110 Protruding Portion (Deflecting Means)
201 Multiple-Glazed Portion
202 Support Base Plate

BEST MODE FOR CARRYING OUT THE INVENTION

Hereinafter, an embodiment of the present invention will be described with reference to FIGS. 1 to 14. This embodiment takes up, as an example of a heat-king cooking apparatus according to the present invention, a steam cooking apparatus that heats and thereby cooks an article-to-be-heated with steam.

The most distinctive feature of the present invention is that, after a heating medium (for example, steam) is supplied to a heating chamber, when a door thereto starts to be opened, cooling air is blown to the opening of the heating chamber so as to form an air curtain. This feature will be described later and, before that, the basic construction of the steam cooking apparatus, on which the present invention is built, will be described with reference to FIGS. 1 to 10.

Figure 1:
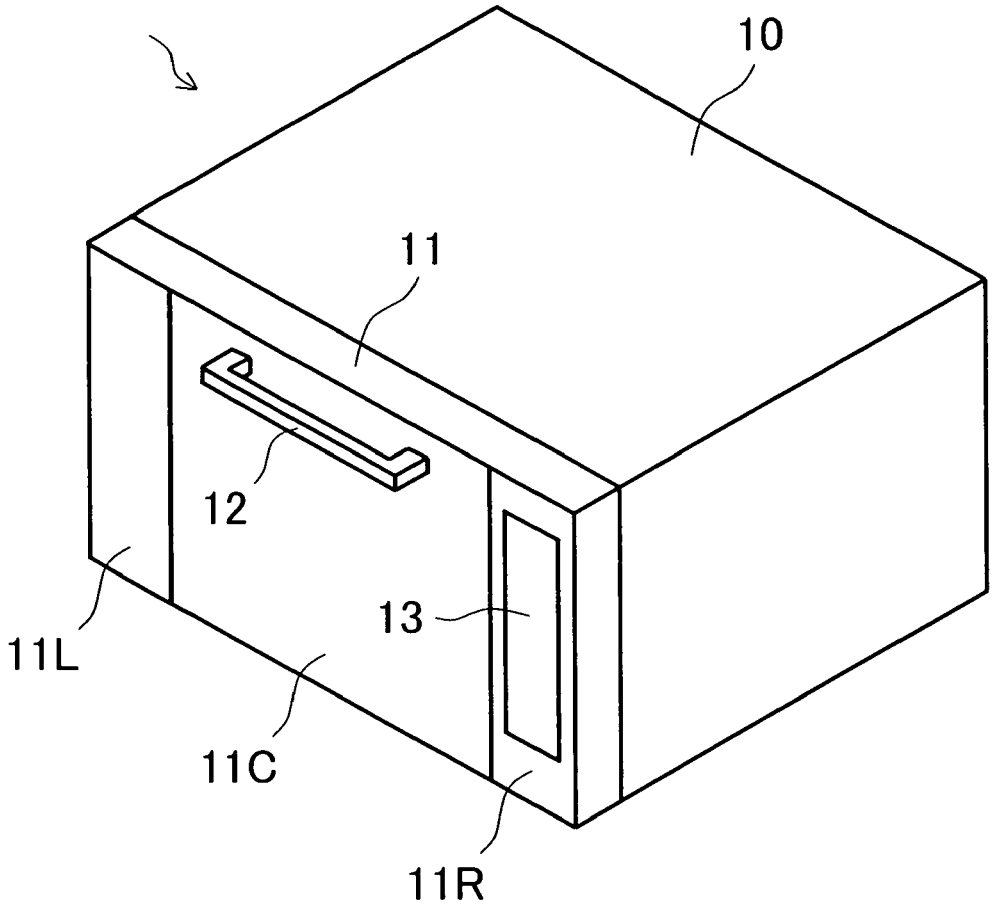
[FIG. 1] An exterior perspective view of a steam cooking apparatus as an example of a heat-cooking apparatus embodying the present invention.
Figure 2:
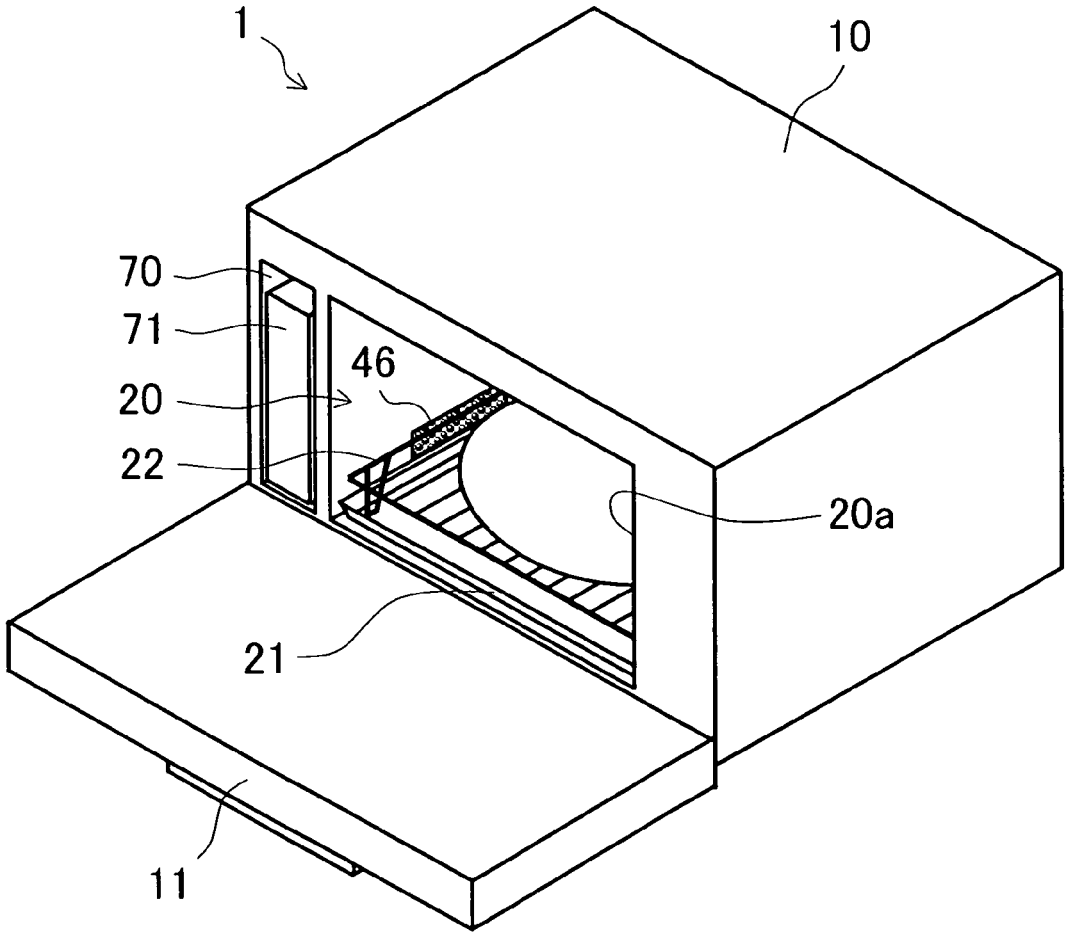
[FIG. 2] An exterior perspective view of the steam cooking apparatus, in a state with a door to a heating chamber opened.
Figure 3:
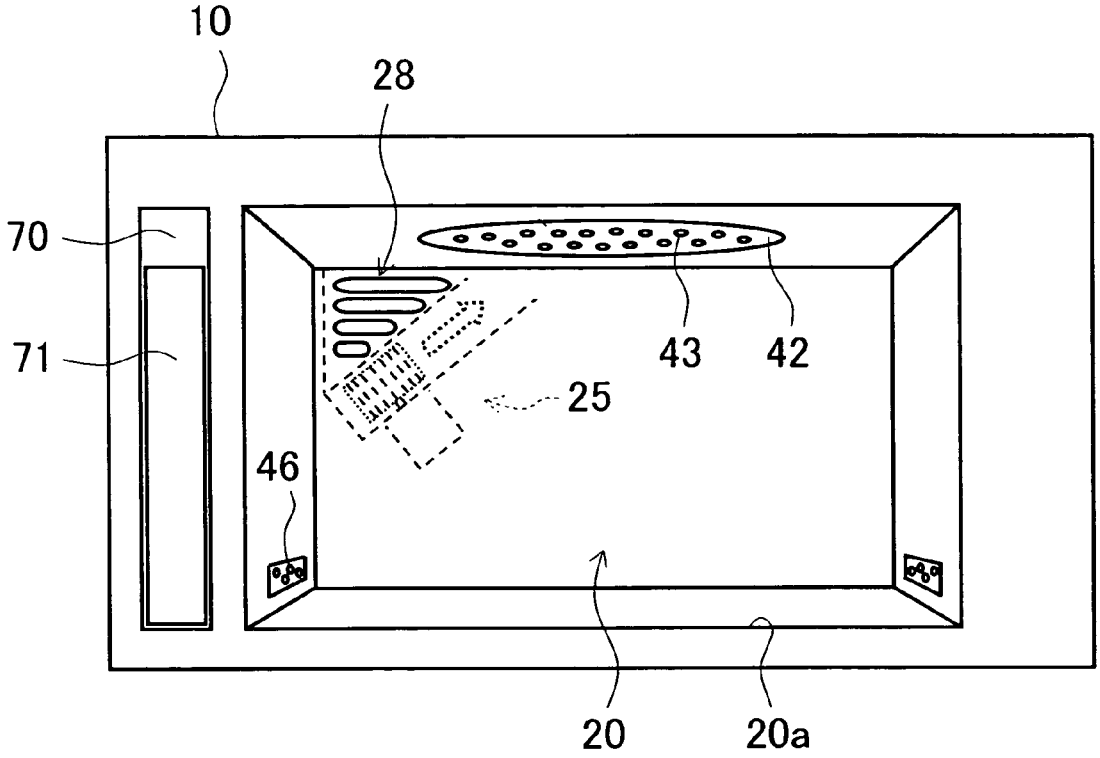
[FIG. 3] A front view of the steam cooking apparatus, in a state with the door to the heating chamber removed.
Figure 4:
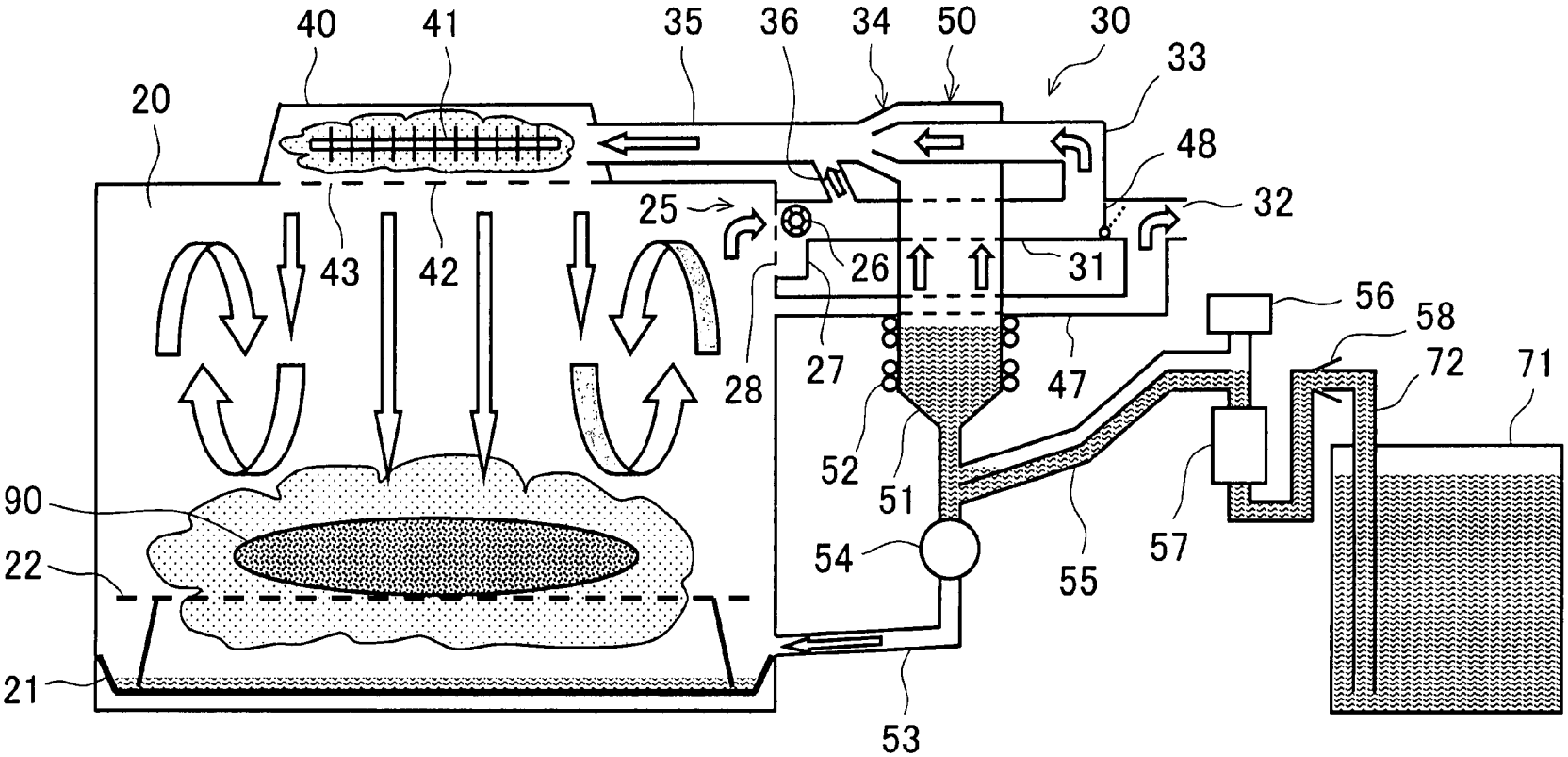
[FIG. 4] A diagram illustrating the basic interior construction of the steam cooking apparatus.
Figure 5:
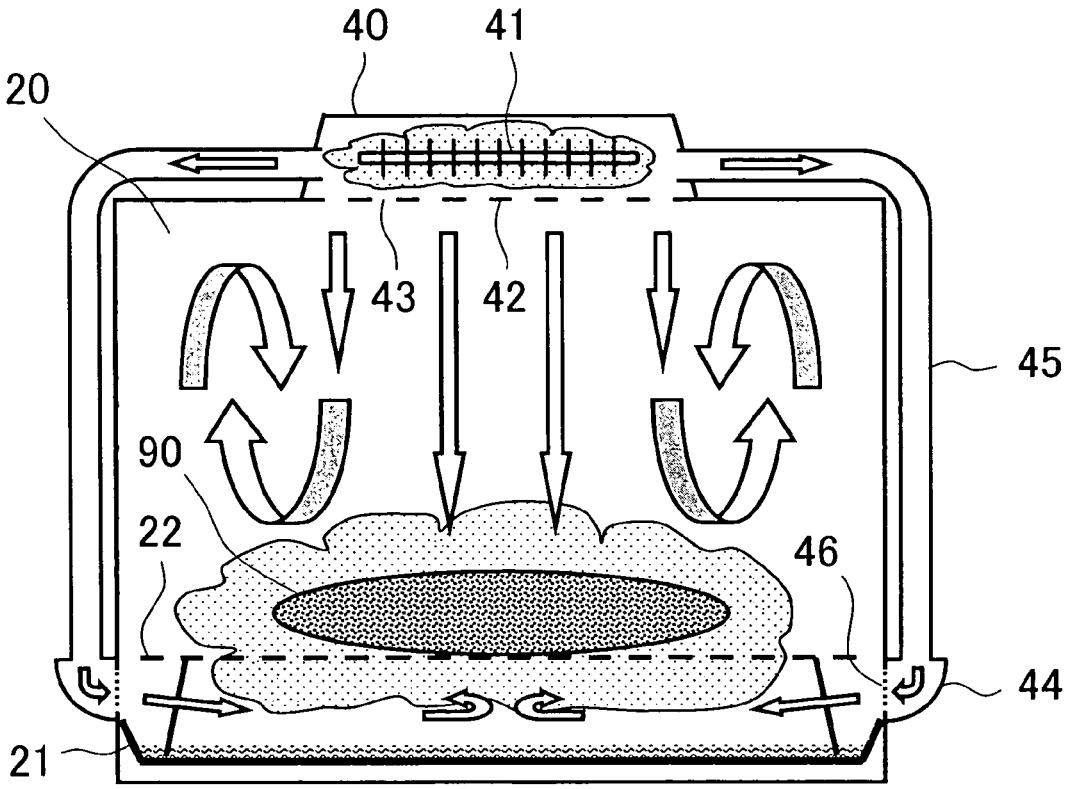
[FIG. 5] A diagram illustrating the basic interior construction of the steam cooking apparatus, as viewed from a direction perpendicular to FIG. 4.
Figure 6:
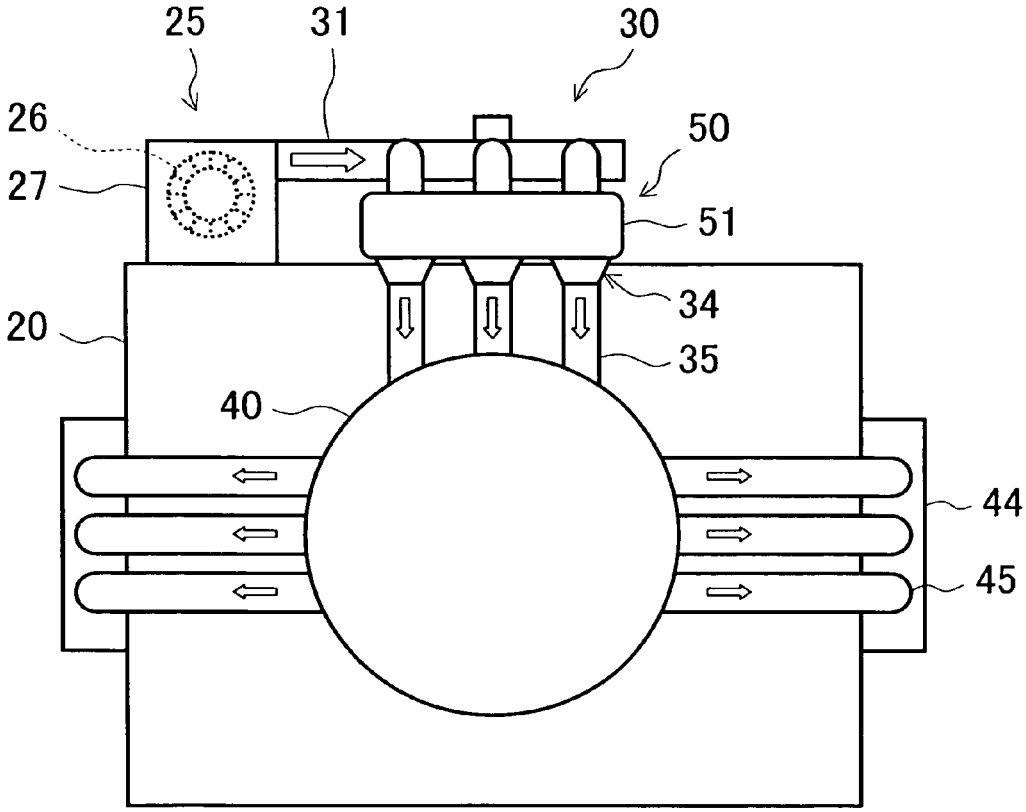
[FIG. 6] A top view of the heating chamber.
Figure 7:
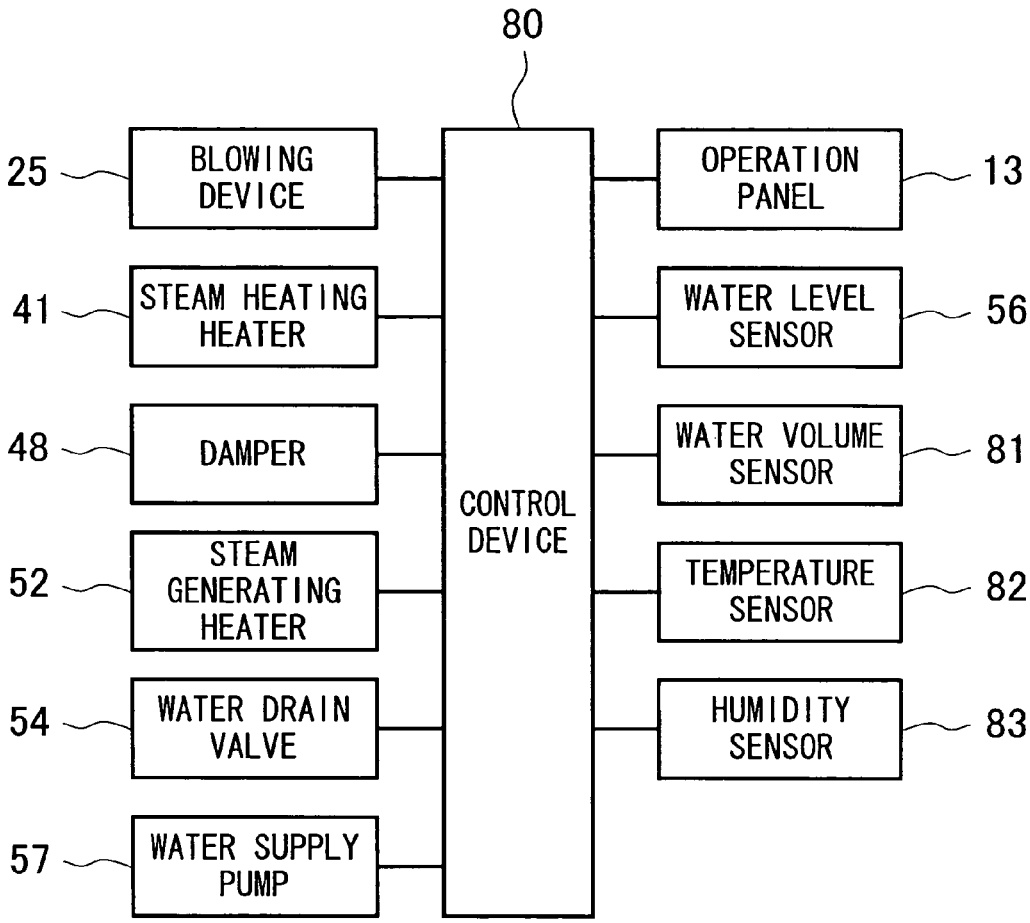
[FIG. 7] A block diagram of a control portion of the steam cooking apparatus.
Figure 8:
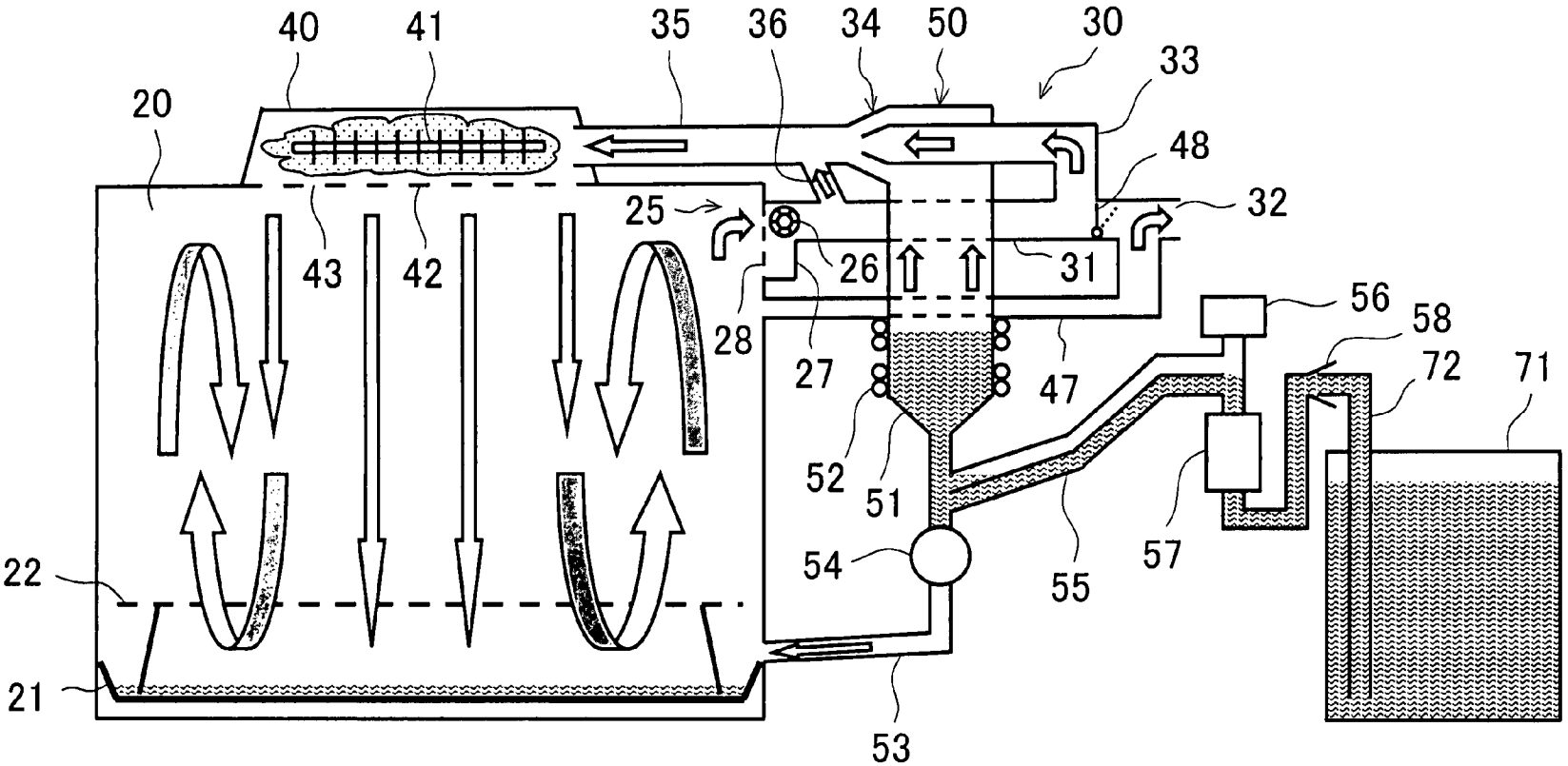
[FIG. 8] A diagram illustrating the streams of steam inside the steam cooking apparatus, in a state with no article-to-be-heated placed inside the heating chamber.
Figure 9:
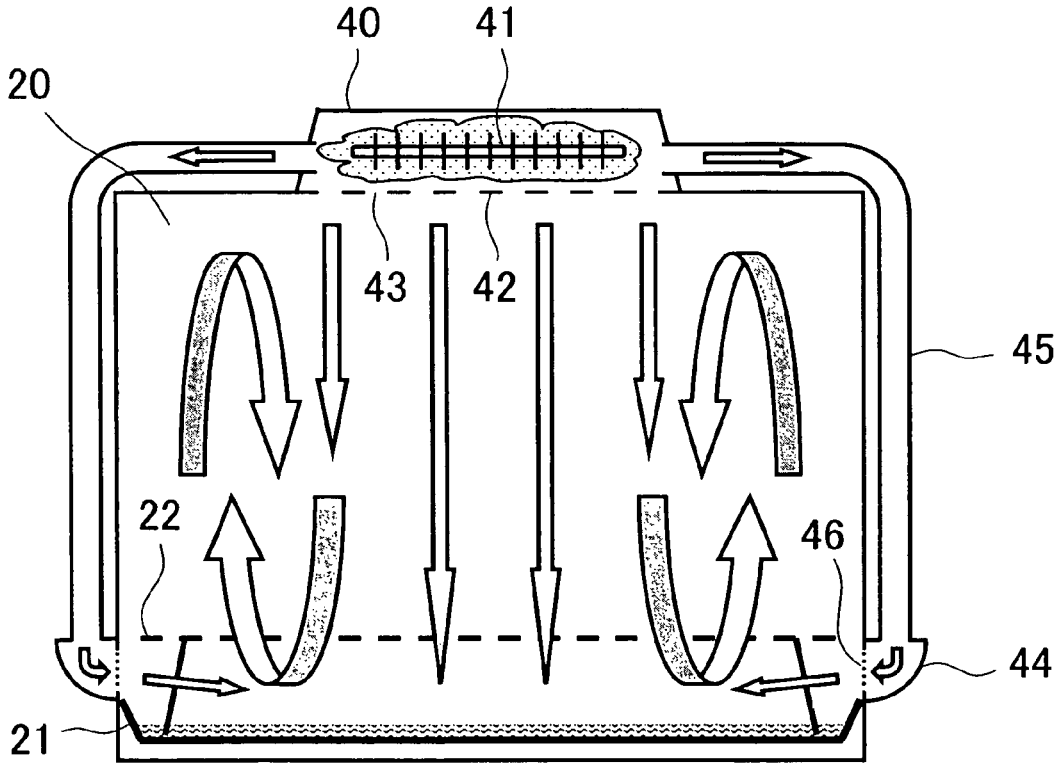
[FIG. 9] A diagram illustrating the streams of steam inside the steam cooking apparatus, as viewed from a direction perpendicular to FIG. 8.
Figure 10:
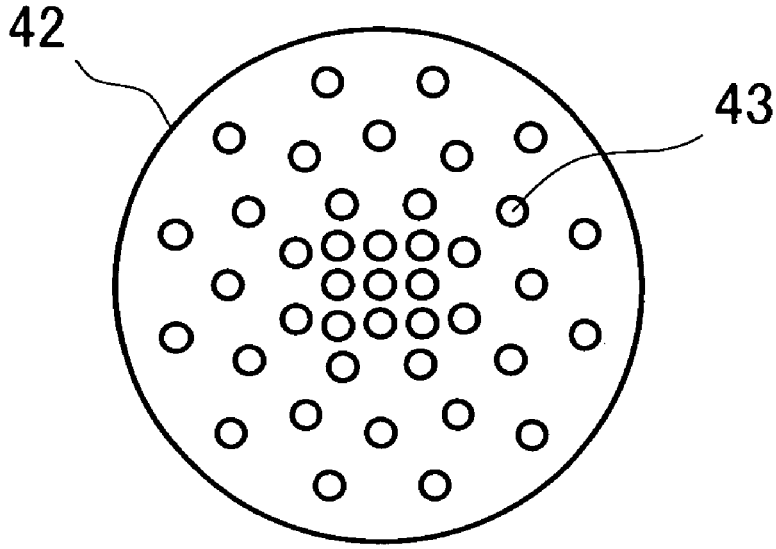
[FIG. 10] A top view of a floor panel of a sub-cavity.

FIG. 1 is an exterior perspective view of a steam cooking apparatus 1 embodying the present invention. FIG. 2 is an exterior perspective view of the steam cooking apparatus 1, in a state with a door 11 to a heating chamber 20 opened. FIG. 3 is a front view of the steam cooking apparatus 1, in a state with the door 11 to the heating chamber 20 removed. FIG. 4 is a diagram illustrating the basic interior construction of the steam cooking apparatus 1. FIG. 5 is a diagram illustrating the basic interior construction of the steam cooking apparatus 1, as viewed from a direction perpendicular to FIG. 4. FIG. 6 is a top view of the heating chamber 20. FIG. 7 is a block diagram of a control portion of the steam cooking apparatus 1. FIG. 8 is a diagram, like FIG. 4, illustrating the basic interior construction, in a state different from what is shown in FIG. 4. FIG. 9 is a diagram, like FIG. 5, illustrating the basic interior construction, in a state different from what is shown in FIG. 5. FIG. 10 is a top view of a floor panel 42 of a sub-cavity 40.

The steam cooking apparatus 1 has a cabinet 10 (casing) in the shape of a rectangular parallelepiped. On the front face of the cabinet 10, a door 11 is provided. The door 11 is for opening and closing an opening 20*a* (see FIG. 2) of a heating chamber 20, and is supported on the cabinet 10 so as to be pivotable about the bottom edge of the door 11 in a vertical plane. Thus, when a handle 12 provided in an upper part of the door 11 is held and pulled frontward, the door 11 changes its position through 90 degrees from a vertical, closed state shown in FIG. 1 to a horizontal, opened state shown in FIG. 2. A middle part 11C of the door 11 has a pane of heat-resistant glass set therein to form a see-through part. On the left and right of the middle part 11C, a left-side part 11L and a right-side part 11R, each finished with a metal decoration plate, are arranged symmetrically. On the right-side part 11R, an operation panel 13 is provided. The operation panel 13 is an operation portion that permits the operation conditions of the apparatus to be set, and includes a display portion that displays the conditions thus set. The structure of the door 11 will be described later.

When the door 11 is opened, the front face of the cabinet 10 appears. In the part of the cabinet 10 corresponding to the middle part 11C of the door 11, the above-mentioned heating chamber 20 is provided. In the part of the cabinet 10 corresponding to the left-side part 11L of the door 11, a water tank chamber 70 is provided. In the part of the cabinet 10 corresponding to the right-side part 11R of the door 11, a control circuit board is arranged inside, with no opening provided in front thereof.

The heating chamber 20 is a chamber in which an article-to-be-heated 90 is heated, and has the above-mentioned opening 20*a* through which the article-to-be-heated 90 is put into and taken out of the heating chamber 20. The heating chamber 20 has the shape of a rectangular parallelepiped, and has the opening 20*a* provided in the front face thereof at which it faces the door 11. The other faces of the heating chamber 20 and the inner face of the door 11 are formed of stainless steel plates. Around the heating chamber 20 and inside the door 11, heat insulation is applied. On the floor surface of the heating chamber 20, a tray 21 formed of a stainless steel plate is placed, and, above the tray 21, a rack 22 formed of stainless steel wire is placed for placing the article-to-be-heated 90 thereon.

Thus, in the construction being described, the opening 20*a* of the heating chamber 20 is provided in the front face of the heating chamber 20; on the other hand, the door 11 is pivotably supported in a bottom part of the cabinet 10 for housing the heating chamber 20 so that the door 11 is openable at the top end thereof with respect to the opening 20*a*.

Inside the heating chamber 20, steam is present that is circulated through an outer circulation passage 30 shown in FIG. 4 (initially, inside the heating chamber 20, air is dominant; when steam cooking is started, however, the air is gradually replaced with steam; throughout the following description, it is assumed that the gas inside the heating chamber 20 has completely been replaced with steam).

The outer circulation passage 30 starts at a blowing device 25 provided outside and above the heating chamber 20. The blowing device 25 is provided with a centrifugal fan 26, a fan casing 27 for housing it, and a motor (unillustrated) for rotating the centrifugal fan 26. Used as the centrifugal fan 26 is a sirocco fan. Used as the motor for rotating the centrifugal fan 26 is a direct-current motor capable of high-speed rotation.

In the rear wall of the heating chamber 20, in a corner in an upper part thereof, a suction port 28 is provided. Through the suction port 28, the steam inside the heating chamber 20 is sucked into the fan casing 27. As shown in FIG. 3, the suction port 28 consists of a plurality of parallel slits arranged one above the next. These slits are increasingly long upward and increasingly short downward so that they together form an opening in the shape of a right-angled triangle. The right-angled corner of the triangle fits the corner of the rear wall of the heating chamber 20. Thus, the suction port 28 is increasingly widely open toward the upper edge of the rear wall of the heating chamber 20, and is increasingly widely open toward the left edge thereof.

After exiting from the fan casing 27 through an outlet port thereof, the outer circulation passage 30 is formed largely of pipes having a circular cross-sectional shape. To the outlet port of the fan casing 27, a first pipe 31 is connected, which has an exhaust port 32 at the other end thereof. To the first pipe 31, a short distance on the upstream side of the exhaust port 32, a second pipe 33 is connected, which is elbow-shaped. A horizontal part of the second pipe 33 protrudes into an upper part of a steam generating device 50 (which will be described in detail later) to form a steam suction ejector 34. The outlet end of the second pipe 33 is tapered to serve as an inner nozzle of the steam suction ejector 34.

To the exit of the steam suction ejector 34, a third pipe 35 is connected, which also forms part of the outer circulation passage 30. The outlet end of the third pipe 35 is connected to a sub-cavity 40 (which will be described in detail later). To the third pipe 35, a bypass pipe 36 is connected, which branches off the first pipe 31.

The sub-cavity 40 is provided above a ceiling part of the heating chamber 20 and, as viewed in a plan view, above a central part of the ceiling part. The sub-cavity 40 has a circular shape as viewed in a plan view, and, inside the sub-cavity 40, a steam heating heater 41 is arranged as means for heating steam. The steam heating heater 41 is built with a sheath heater. In the ceiling part of the heating chamber 20, an opening as large as the sub-cavity 40 is formed, and, in this opening, a floor panel 42 that forms the floor surface of the sub-cavity 40 is fitted.

In the floor panel 42, a plurality of upper jet holes 43 are formed. The upper jet holes 43 consist of small holes that are each directed straight downward and that are so located as to spread largely over the entire surface of the panel. Here, the upper jet holes 43 are so located as to spread within a plane, that is, two-dimensionally. It is, however, also possible to form elevations and depressions on the floor panel 42 so that the locations of the upper jet holes 43 spread quasi-three-dimensionally. As viewed in a plan view, the floor panel 42 may have a circular shape, or may have a rectangular shape geometrically similar to the heating chamber 20 as viewed in a plan view.

Both the upper and lower surfaces of the floor panel 42 are finished to be dark-colored through surface treatment such as painting. This permits the floor panel 42 to absorb the heat radiated from the steam heating heater 41. The radiated heat absorbed by the floor panel 42 at the upper surface thereof is then radiated, from the equally dark-colored lower surface of the floor panel 42, into the heating chamber 20. This reduces the rise in the temperatures inside and on the exterior surface of the sub-cavity 40, enhancing safety. Moreover, as a result of the heat radiated from the steam heating heater 41 being conducted through the floor panel 42 to the heating chamber 20, the heating chamber 20 is heated more efficiently. Incidentally, the floor panel 42 may be formed of a metal material whose color grows dark as use progresses; instead, the floor panel 42 may be formed of a dark-colored ceramic molding.

Instead of the floor surface of the sub-cavity 40 being formed with the floor panel 42 separately provided, the ceiling plate of the heating chamber 20 may, as it is, be shared as the floor surface of the sub-cavity 40. In this case, the part of the ceiling plate corresponding to the sub-cavity 40 has the upper jet holes 43 formed therein, and has the upper and lower surfaces thereof finished to be dark-colored.

Outside the left and right side walls of the heating chamber 20, small sub-cavities 44 are provided as shown in FIGS. 5 and 6. The sub-cavities 44 are connected to the sub-cavity 40 through ducts 45 to receive steam from the sub-cavity 40. The ducts 45 are formed as pipes having a circular cross-sectional shape, and are preferably formed of pipes of stainless steel.

In lower parts of the side walls of the heating chamber 20, a plurality of side jet holes 46 are formed in positions corresponding to the sub-cavities 44. The side jet holes 46 are small holes that are each directed toward the article-to-be-heated 90 placed inside the heating chamber 20, more precisely, toward under the article-to-be-heated 90. The side jet holes 46 permit steam to be jetted out therethrough toward the article-to-be-heated 90 placed on the rack 22. The heights and directions of the side jet holes 46 are so set that the steam blown out reaches under the article-to-be-heated 90. Moreover, the side jet holes 46 are so positioned and/or directed that the steam blown out from the left and right sides meets under the article-to-be-heated 90.

The side jet holes 46 may be formed in a separately provided panel, or may be formed in the side walls of the heating chamber 20 themselves, with small holes formed directly therein. In this respect, what has been stated above in connection with the upper jet holes 43 equally applies. In contrast to the sub-cavity 40, however, the parts corresponding to the sub-cavities 44 need not be finished to be dark-colored.

The total area of the side jet holes 46 at the left and right sides is made larger than the total area of the upper jet holes 43. Since the side jet holes 46 thus have a large total area, a large amount of steam needs to be supplied thereto. To achieve this, for each sub-cavity 44, a plurality of ducts 45 (in the figures, three of them) are provided.

Back in FIG. 4, to the upper part of the heating chamber 20, one end of a steam exhaust pipe 47 is connected. The other end of the steam exhaust pipe 47 is connected to the first pipe 31, immediately inward of the exhaust port 32. Inside the first pipe 31, between where it is connected to the second pipe 33 and where it is connected to the steam exhaust pipe 47, a damper 48 is provided that is electrically driven. The damper 48 opens and closes the passage leading from the blowing device 25 to the exhaust port 32.

Next, the structure of the steam generating device 50 will be described. The steam generating device 50 is provided with a cylindrical pot 51 arranged with the center line thereof vertical. The pot 51 is closed at the top, and, as described previously, has the steam suction ejector 34 formed in a top part thereof.

The pot 51 is formed of a metal having good thermal conductivity. Suitable as such a metal is aluminum, but copper or an alloy thereof may be used instead. Since copper and its alloys form patina, however, it is also possible to use, instead, stainless steel free from the disadvantage of forming patina, through with slightly lower thermal conductivity.

Water is put inside the pot 51, and is heated with a steam generating heater 52 provided in close contact with the exterior surface of the pot 51. The steam generating heater 52 is built with a ring-shaped sheath heater.

As shown in FIG. 6, as viewed in a plan view, the pot 51 is flat, and is arranged with a flat face thereof placed along the rear wall of the heating chamber 20. The outer circulation passage 30 has three of the steam suction ejector 34, and accordingly three of the third pipe 35 are connected to the sub-cavity 40.

In this embodiment, the sub-cavity 40 and the steam generating device 50 together form heating medium generating means for generating the heating medium to be supplied to the heating chamber 20, and thus form steam generating means for generating steam as the heating medium.

The pot 51 has a funnel-shaped bottom part, from which a water drain pipe 53 runs downward. The water drain pipe 53 has a lower part thereof bent so as to run toward the heating chamber 20 with a slope of a predetermined angle, and, at the lower end, penetrates a side wall of the heating chamber 20 to reach above the tray 21. On the way along the drain pipe 53, a water drain valve 54 is provided.

The pot 51 is supplied with water through a water supply pipe 55. The water supply pipe 55 is connected to the water drain pipe 53, above the water drain valve 54. At the highest part of the water supply pipe 55, a water level sensor 56 is provided.

From the part where the water level sensor 56 is provided to the other end thereof, the water supply pipe 55 is U-shaped, on the way along which part a water supply pump 57 is provided. This end of the water supply pipe 55 points sideways, and has a funnel-shaped inlet port 58 formed thereat.

Into the water tank chamber 70, a water tank 71 in the shape of a rectangular parallelepiped having a small lateral width is inserted. From the water tank 71 runs an elbow-shaped water supply pipe 72, which is connected to the inlet port 58 of the water supply pipe 55.

The operation of the steam cooking apparatus 1 is controlled by a control device 80 shown in FIG. 7. The control device 80 includes a microprocessor and a memory, and controls the steam cooking apparatus 1 according to a predetermined program. The status of control is indicated in a display portion on the operation panel 13. The control device 80 receives operation instructions from various operation keys arranged on the operation panel 13 as they are operated. On the operation panel 13, a sound generating device is also arranged that generates various sounds.

Connected to the control device 80 is not only the operation panel 13 but also the blowing device 25, the steam heating heater 41, the damper 48, the steam generating heater 52, the water drain valve 54, the water level sensor 56, and the water supply pump 57. Further connected to the control device 80 are: a water volume sensor 81 for sensing the amount of water inside the water tank 71; a temperature sensor 82 for sensing the temperature inside the heating chamber 20; and a humidity sensor 83 for sensing the humidity inside the heating chamber 20.

The steam cooking apparatus 1 is operated and operates basically as follows.

First, the water tank 71 is taken out of the water tank chamber 70 (see FIG. 2), and then water is poured into the tank through an unillustrated water supply port thereof. Filled with water, the water tank 71 is then put back into the water tank chamber 70 and is set in position. When the end of the water supply pipe 72 is confirmed to have been securely connected to the inlet port 58 of the water supply pipe 55, a power key on the operation panel 13 is pressed to turn the power on. Now, the water supply pump 57 starts to operate, and water starts to be supplied to the steam generating device 50. At this point, the water drain valve 54 is closed.

Water collects inside the pot 51 from the bottom up. When the water level there is detected to have reached a predetermined level by the water level sensor 56, water stops being supplied.

Now, with a predetermined amount of water in the pot 51, electric power starts to be supplied to the steam generating heater 52. The steam generating heater 52 heats, through the side wall of the pot 51, the water in the pot 51.

At the same time that electric power starts to be supplied to the steam generating heater 52, electric power starts to be supplied also to the blowing device 25 and the steam heating heater 41. The blowing device 25 sucks in, through the suction port 28, the steam in the heating chamber 20, and blows it out into the outer circulation passage 30. Here, since the blowing out of steam is achieved with the centrifugal fan 26, a higher pressure can be produced than with a propeller fan. In addition, since the centrifugal fan 26 is rotated at a high speed with a direct-current motor, the stream produced has an extremely high flow speed.

The high flow speed of the stream here helps reduce the cross-sectional area of the flow passage in comparison with the flow rate. This permits the pipe that largely forms the outer circulation passage 30 to have a circular cross-sectional shape and a comparatively small diameter, and thus helps give the outer circulation passage 30 a smaller surface area than when it is formed as a duct having a rectangular cross-sectional shape. Thus, although hot steam passes through it, the outer circulation passage 30 dissipates less heat, enhancing the energy efficiency of the steam cooking apparatus 1. In a case where the outer circulation passage 30 is wrapped with a heat insulating material, the amount of it needed can be reduced.

At this point, the damper 48 closes the passage leading from the blowing device 25 to the exhaust port 32. The steam blown out of the blowing device 25 under pressure flows through the first pipe 31 into the second pipe 33, and then flows through the third pipe 35 into the sub-cavity 40. The steam is then heated by the steam heating heater 41 inside the sub-cavity 40, and is then jetted out downward through the upper jet holes 43.

When the water in the pot 51 boils, it generates saturated steam at 100° C. and at one atmosphere. The saturated steam mixes, at the steam suction ejector 34, with the stream circulated through the outer circulation passage 30. The ejector structure here permits the saturated steam to be sucked up and then out quickly. Moreover, the ejector structure prevents the steam generating device 50 from being acted upon by a pressure, and thereby permits the saturated steam to be discharged freely.

On the downstream side of the steam suction ejector 34, steam is blown into the third pipe 35 from the first pipe 31 through the bypass pipe 36. The bypass pipe 36 thus helps reduce the pressure loss in the circulation passage, and thereby permits the centrifugal fan 26 to be driven efficiently.

The steam that has exited from the steam suction ejector 34 flows, at a high speed, into the sub-cavity 40. The steam that has entered the sub-cavity 40 is heated to 300° C. by the steam heating heater 41, and is thus turned into overheated steam. Part of the overheated steam is jetted out downward through the upper jet holes 43. Another part of the overheated steam flows through the ducts 45 into the sub-cavities 44, and is then jetted out sideways through the side jet holes 46.

It should be noted that, for the sake of convenience, the following conventions apply in the present specification. Steam generated by heating water is called heated steam. In the sub-cavity 40, the steam supplied thereto is further heated to become higher-temperature steam. Whenever the steam jetted out of the sub-cavity 40 needs to be distinguished from other steam, it is referred to as overheated steam. Thus, it should be understood that "heated steam" covers a broader concept including "overheated steam".

FIGS. 8 and 9 show the streams of steam as observed when no article-to-be-heated 90 is placed inside the heating chamber 20. Through the upper jet holes 43, steam is jetted out downward so strongly as to reach the floor surface of the heating chamber 20. The steam hits the floor surface and changes its flow direction outward. The steam thus moves out of the downward blow and starts to rise. Since steam, in particular overheated steam, is light, this turning of the flow direction occurs naturally. Consequently, inside the heating chamber 20, convection occurs with a falling stream at the center and a rising stream around, as indicated by arrows in the figure.

To produce effective convection, the upper jet holes 43 are arranged ingeniously. Specifically, as shown in FIG. 10, the upper jet holes 43 are so arranged as to be dense in a central part of the floor panel 42 and sparse in a peripheral part thereof. This weakens the strength of the downward blow of steam in the peripheral part of the floor panel 42 so as not to hamper the rise of steam, and thus helps produce more effective convection.

Through the side jet holes 46, steam is jetted out sideways. The steam meets in a central part of the heating chamber 20, and then enters the convection produced by the steam from the upper jet holes 43. The steam flowing by convection is partly sucked out through the suction port 28. The steam then circulates through the outer circulation passage 30 to the sub-cavity 40, and then returns to the heating chamber 20. In this way, the steam inside the heating chamber 20 repeatedly flows out into the outer circulation passage 30 and then back into the heating chamber 20.

As time passes, the amount of steam inside the heating chamber 20 increases. Excessive steam is exhausted out of the heating chamber 20 through the steam exhaust pipe 47 and the exhaust port 32. If the steam is exhausted, as it is, inside the cabinet 10, condensation occurs inside the cabinet 10, leading to undesirable results such as formation of rust and leakage of electric current. If the steam is exhausted, as it is, outside the cabinet 10, condensation occurs on a wall surface of a kitchen, leading to growth of mold. To avoid these inconveniences, the steam is condensed by being passed through a maze-like condensation passage (unillustrated). The water dripping out of the condensation passage is collected in the tray 21, so as to be disposed of, along with water produced otherwise, after the completion of cooking.

When overheated steam starts to be jetted out, the temperature inside the heating chamber 20 rises quickly. When the temperature sensor 82 detects that the temperature inside the heating chamber 20 has reached the range of temperature in which cooking is possible, the control device 80 indicates a corresponding message on the operation panel 13 and sounds an alert. Notified with these message and alert that the steam cooking apparatus 1 is ready to cook, the user opens the door 11, and puts an article-to-be-heated 90 in the heating chamber 20.

When the door 11 starts to be opened, the control device 80 switches the damper 48 into a state in which it opens the passage leading from the blowing device 25 to the exhaust port 32. The steam inside the heating chamber 20 is sucked out by the blowing device 25 and exhausted out through the exhaust port 32. The steam blown out of the blowing device 25 under pressure flows straight to the exhaust port 32, and thus almost no part of the steam flows to the steam generating device 50. This reduces the amount of steam that flows into the sub-cavity 40, and thus now the jetting out, if ever, of steam through the upper jet holes 43 and the side jet holes 46 is extremely weak. As long as the door 11 is open, the damper 48 keeps open the passage leading to the exhaust port 32.

Here, if the blowing device 25 is started all over from a resting state to achieve exhaustion through the exhaust port 32, a time lag arises until it reaches a steadily blowing state. In this embodiment, the blowing device 25 is already operating, and thus no time lag arises. Moreover, the stream that has thus far been circulating through the heating chamber 20 and the outer circulation passage 30 becomes, as it is, the stream exhausted out through the exhaust port 32. Thus, no time lag arises even for changing the direction of the stream. This makes it possible to quickly exhaust the steam inside the heating chamber 20 and thereby to shorten the time for which the door 11 needs to be kept inhibited from being opened.

When the user starts to open the door 11, this condition can be recognized by the control device 80, for example, in the following manner. A latch for keeping the door 11 closed is provided between the cabinet 10 and the door 11, and a latch lever for unlocking the latch is provided on the a handle 12 so as to be exposed out of it. A switch that opens and closes as the latch or the latch lever is operated is arranged inside the door 11 or the a handle 12 so that, when the user grips the handle 12 and the latch lever to unlock, the switch transmits a signal to the control device 80.

Even when the blowing device 25 and the damper 48 are driven as described above with a view to exhausting the steam inside the heating chamber 20, it is impossible to completely exhaust the steam inside the heating chamber 20 as soon as the door starts to be opened. Thus, in reality, when the door starts to be opened, not a little high-temperature steam is present inside the heating chamber 20. In this state, if the door 11 is instantaneously opened, the steam inside the heating chamber 20 overflows frontward, where the user stands, and may cause the user to be burnt on the face, hand, or other part of the body. Similar circumstances occur when the door 11 starts to be opened after completion of heat-cooking inside the heating chamber 20. To eliminate the danger to the user in these circumstances is the main purpose of the present invention, and how that is achieved will be described in detail later.

Subsequently, when an article-to-be-heated 90 is placed on the rack 22 and the door 11 is closed, the damper 48 is switched back to a state in which it closes the passage leading to the exhaust port 32. Now, steam starts to flow into the sub-cavity 40 again, and overheated steam starts to be jetted out through the upper jet holes 43 and the side jet holes 46 again, starting the cooking of the article-to-be-heated 90.

Heated to about 300° C. and jetted out through the upper jet holes 43, the overheated steam hits the article-to-be-heated 90 and delivers heat thereto. In this process, the temperature of the steam drops to about 250° C. The overheated steam that has touched the surface of the article-to-be-heated 90 condenses on the surface of the article-to-be-heated 90 and thereby releases latent heat. This too heats the article-to-be-heated 90.

After delivering heat to the article-to-be-heated 90, the steam changes its direction outward and moves out of the downward blow. Since steam is light as described previously, having moved out of the downward blow, the steam starts to rise, producing convection inside the heating chamber 20 as indicated by arrows. This convection maintains the temperature inside the heating chamber 20, and keeps the article-to-be-heated 90 hit by the overheated steam just heated in the sub-cavity 40, permitting a large amount of heat to be applied quickly to the article-to-be-heated 90.

The steam jetted out sideways through the side jet holes 46 reaches, from the left and right sides, under the rack 22 and meets under the article-to-be-heated 90. Although the steam jetted out through the side jet holes 46 is directed originally in directions tangential to the surface of the article-to-be-heated 90, as a result of the steam from the left and right sides meeting, it does not flow straight on, but stagnates and fills under the article-to-be-heated 90. The steam thus behaves as if blown in directions normal to the surface of the article-to-be-heated 90. This ensures that the heat of steam is delivered to the lower part of the article-to-be-heated 90.

As described above, with the steam from the side jet holes 46, the part of the article-to-be-heated 90 that is not hit by the steam from the upper jet holes 43 is as well cooked as the upper part. This contributes to an evenly-cooked, neat-looking result. Moreover, the article-to-be-heated 90 receives heat evenly from around the surface thereof. Thus, the article-to-be-heated 90 is heated to the center sufficiently in a short time.

The steam from the side jet holes 46, too, originally has a temperature of about 300° C., and, after it hits the article-to-be-heated 90, its temperature drops to about 250° C., during which process the steam delivers heat to the article-to-be-heated 90. Moreover, when the steam condenses on the surface of the article-to-be-heated 90, it releases latent heat, and thereby heats the article-to-be-heated 90.

After delivering heat to the lower part of the article-to-be-heated 90, the steam from the side jet holes 46 enters the convection produced by the steam from the upper jet holes 43. The steam flowing by convection is partly sucked out through the suction port 28. The steam then circulates through the outer circulation passage 30 to the sub-cavity 40, and then returns to the heating chamber 20. In this way, the steam inside the heating chamber 20 repeatedly flows out into the outer circulation passage 30 and then back into the heating chamber 20.

The side jet holes 46 are located away from the sub-cavity 40, and are therefore located disadvantageously from the perspective of jetting out steam. Nevertheless, as a result of the total area of the left and right side jet holes 46 being larger than the total area of the upper jet holes 43, a sufficient amount of steam can be guided to the side jet holes 46, permitting the upper and lower parts of the article-to-be-heated 90 to be heated more evenly.

Since the article-to-be-heated 90 is heated while the gas inside the heating chamber 20 is circulated, the steam cooking apparatus 1 operates with high energy efficiency. Moreover, since the overheated steam from above is jetted out downward through the plurality of upper jet holes 43 that are so located as to spread largely over the entire floor panel 42, largely the entire article-to-be-heated 90 is enveloped in the steam from above. As a result of overheated steam hitting the article-to-be-heated 90, and this hitting taking place over a large area, the heat of overheated steam is quickly delivered to the article-to-be-heated 90. Moreover, as a result of the steam having entered the sub-cavity 40 being heated by the steam heating heater 41 and thus expanding, the steam is jetted out with increased strength, and thus hits the article-to-be-heated 90 at an increased speed. This permits the article-to-be-heated 90 to be heated further quickly.

The centrifugal fan 26 can generate a pressure higher than a propeller fan can, and thus helps increase the strength with which steam is jetted out through the upper jet holes 43. This permits overheated steam to be jetted out so strongly as to reach the floor surface of the heating chamber 20, and thus permits the article-to-be-heated 90 to be heated intensely. The centrifugal fan 26 is rotated at a high speed with a direct-current motor to produce a strong stream. This helps enhance the benefits mentioned above.

In a case where the article-to-be-heated 90 is, for example, meat or the like, as it is heated and its temperature rises, melted fat may drip down from the article-to-be-heated 90. In a case where the article-to-be-heated 90 is a beverage or the like in a container, when it boils, part of it may boil over. Anything that drips down or boils over in such a way is collected in the tray 21, so as to be disposed of after the completion of cooking.

As the steam generating device 50 continues generating steam, the water level inside the pot 51 falls. When the water level sensor 56 detects that the water level has fallen to a predetermined level, the control device 80 restarts the operation of the water supply pump 57. The water supply pump 57 sucks up water from the water tank 71 to supply as much Water as has evaporated. When the water level sensor 56 detects that the water level inside the pot 51 has risen to a predetermined level, the control device 80 stops the operation of the water supply pump 57.

On completion of cooking, the control device 80 indicates a corresponding message on the operation panel 13 and sounds an alert. Notified with these message and alert that the steam cooking apparatus 1 has finished cooking, the user opens the door 11, and takes the article-to-be-heated 90 out of the heating chamber 20. At this point also, the damper 48 is so switched that the steam inside the heating chamber 20 is exhausted through the exhaust port 32.

In a case where there is a long pause before cooking is performed next time, or in a case where, in a cold-climate area, no cooking is scheduled until the morning the next day, after the completion of cooking, the water drain valve 54 is opened through operation on the operation panel 13 to remove water from the pot 51. This prevents the water inside the pot 51 from being infected with germs, algae, and the like and from freezing.

Next, as the most distinctive feature of the present invention, how an air curtain is formed will be described with reference to FIGS. 11 to 14.

Figure 11:
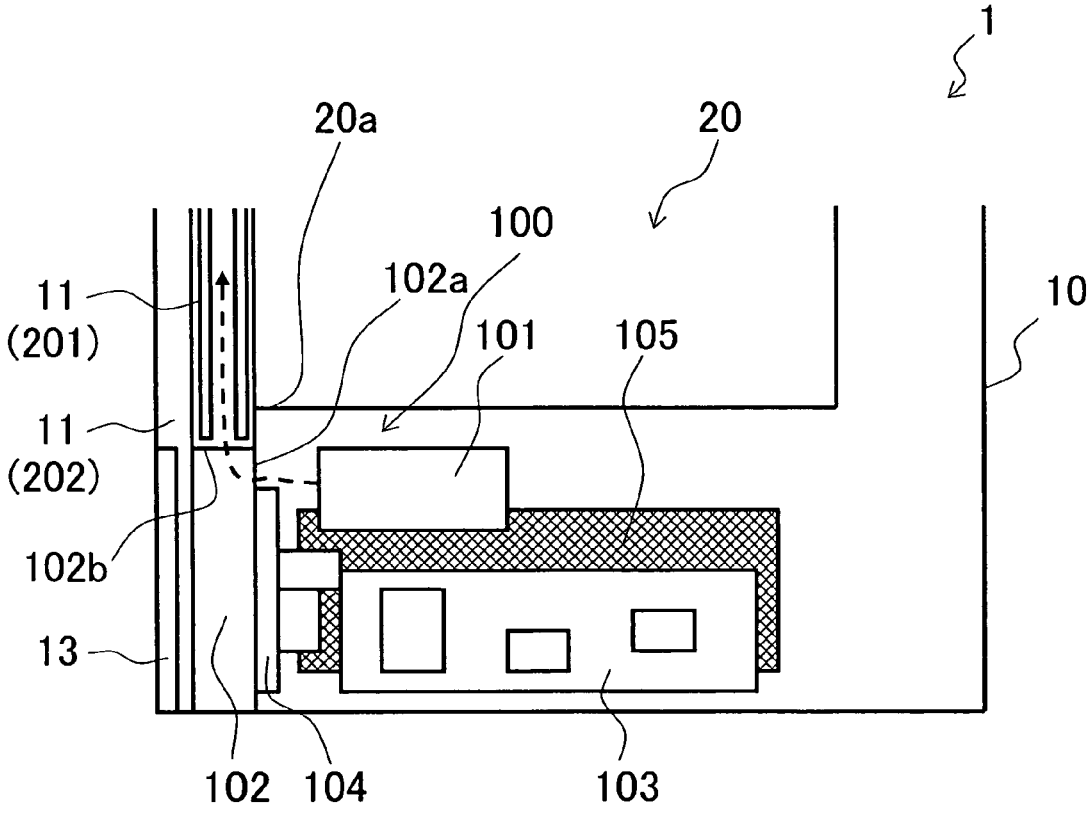
[FIG. 11] A horizontal cross-sectional view schematically showing the details of the construction of a principal part inside the steam cooking apparatus.
Figure 12:
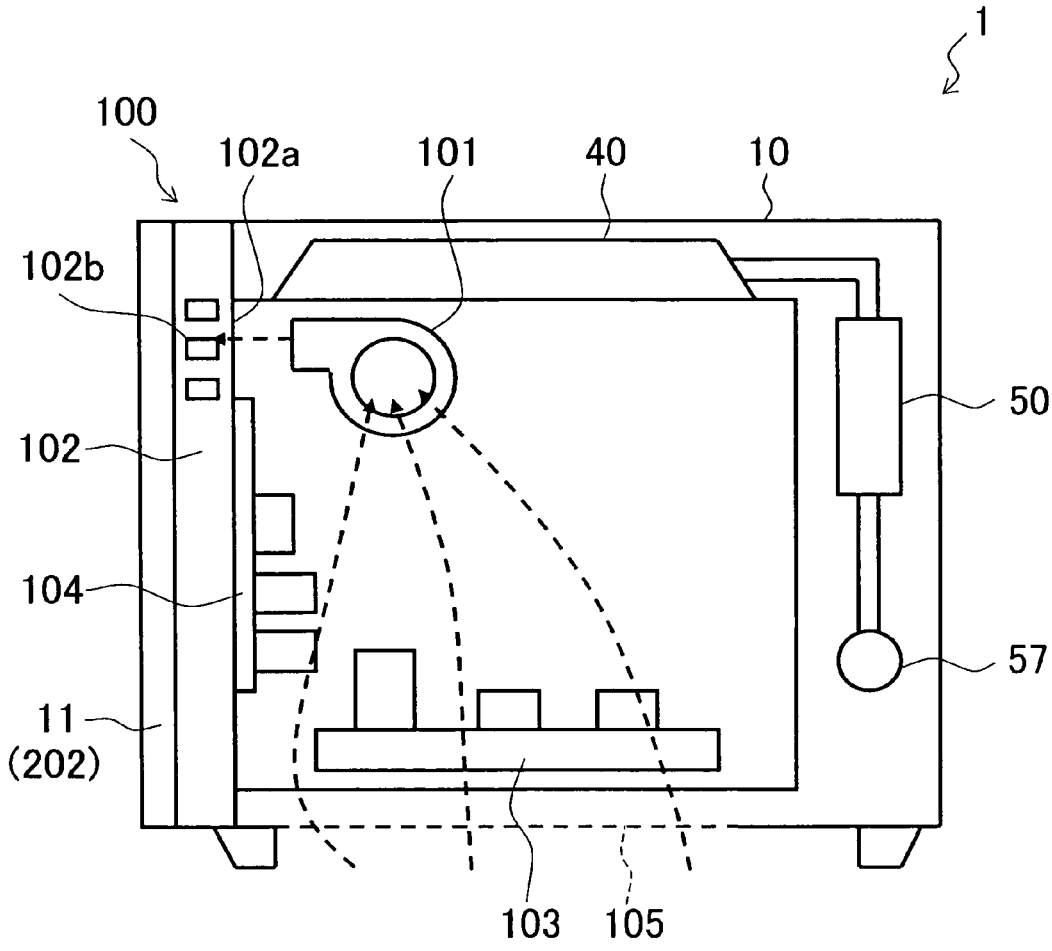
[FIG. 12] A vertical cross-sectional view of the steam cooking apparatus shown in FIG. 11.

FIG. 11 is a horizontal cross-sectional view schematically showing the details of the construction of a principal part inside the steam cooking apparatus 1. FIG. 12 is a vertical cross-sectional view of the steam cooking apparatus 1 shown in FIG. 11. The steam cooking apparatus 1 of this embodiment is provided with blowing means 100 that blows cooling air to the opening 20*a* of the heating chamber 20 when, after the heating medium (steam) is supplied to the heating chamber 20 by the steam generating means, the door 11 starts to be opened. As a result of the blowing means 100 blowing cooling air, an air curtain is formed in front of the opening 20*a*.

For easy understanding of the description of the blowing means 100, first, the structure of the door 11 will be described in detail. The door 11 is composed of a multiple-glazed portion 201 and a support base plate 202.

The multiple-glazed portion 201 has a plurality of heat-resistant transparent glass plates arranged to face one another with a predetermined gap in between so that, when the door 11 is closed, part of the multiple-glazed portion faces at least the opening 20*a* of the heating chamber 20. In this embodiment, the multiple-glazed portion 201 is built with two transparent glass plates. The number of transparent glass plates used here may instead be three or more. The multiple-glazed portion 201 has openings in both side faces thereof so that air can be passed through the gap between the two transparent glass plates.

The support base plate 202 has an area that is larger than the area of the multiple-glazed portion 201 and that is so large as to cover the entire opening 20*a* side face of the heating chamber 20. When the door 11 is closed, the support base plate 202 supports the multiple-glazed portion 201 from the face thereof facing away from the opening 20*a*. The operation panel 13 mentioned earlier is located on this support base plate 202, in a position outside the part thereof facing the multiple-glazed portion 201. The support base plate 202 may be shared as the outermost transparent glass plate of the multiple-glazed portion 201.

Next, the blowing means 100 will be described in detail. The blowing means 100 includes a cooling fan 101 and a decoration box 102.

The cooling fan 101 is one originally provided inside the steam cooking apparatus 1 for the purpose of cooling a power supply circuit board 103, an operation circuit board 104, and the like provided inside it, and is driven with an unillustrated motor. The driving of this motor is controlled by the control device 80 shown in FIG. 7. The power supply circuit board 103 is for supplying electric power to the different blocks inside the apparatus, and is provided, for example, in a part of the cabinet 10 near the bottom thereof. The operation circuit board 104 is for driving the different blocks according to the input operation performed on the operation panel 13, and is electrically connected to the operation panel 13 through a cable (unillustrated). The operation circuit board 104 is arranged, for example, in a position facing the operation panel 13 inside the cabinet 10 when the door 11 is closed. In a bottom part of the cabinet 10, a suction port 105 is provided through which to suck in cooling air.

Thus, when the control device 80 drives the motor to rotate the cooling fan 101, air outside the apparatus is, as cooling air, sucked into the apparatus through the suction port 105 so that, with this cooling air, the power supply circuit board 103 and the operation circuit board 104 can be cooled.

The decoration box 102 has the shape of a rectangular parallelepiped in exterior appearance, and is arranged, when the door 11 is closed, between the cabinet 10 and the operation panel 13 on the support base plate 202, at a side of the multiple-glazed portion 201. The original function of the decoration box 102 is to decorate the cabinet 10 so that it looks symmetric about the opening 20*a* as viewed from in front when the door 11 is open. Thus, the arrangement of the decoration box 102 helps keep the cabinet 10 neat-looking even when the door 11 is open.

The decoration box 102 is hollow inside an upper part thereof. On the rear face of the decoration box 102, that is, on the face thereof facing the cabinet 10, in a position deviated from the operation circuit board 104, an opening 102*a* is provided. On the other hand, in an upper part of the side face of the decoration box 102 facing the opening 20*a* of the heating chamber 20, slits 102*b* are provided. The slits 102*b* are provided above the height corresponding to half the vertical dimension of the opening 20*a* of the heating chamber 20 (for example, at the height corresponding to one-third down the vertical dimension of the opening 20*a* from the top thereof). In a part of the cabinet 10 facing the opening 102*a* of the decoration box 102, an unillustrated opening is formed.

With the decoration box 102 structured as described above, the air sucked in by the cooling fan 101 and used to cool the power supply circuit board 103 an the operation circuit board 104 is then introduced into the decoration box 102 through the opening 102*a* in the rear face thereof. The air is then blown out of the decoration box 102 through the slits 102*b* in the side face thereof into the opening 20*a* of the heating chamber 20. Thus, the decoration box 102 serves, in addition to the decorating function mentioned above, the function as deflecting means for deflecting the air sucked in from outside the apparatus by the cooling fan 101 so that the air is blown to the opening 20*a* of the heating chamber 20.

Next, the operation of the steam cooking apparatus 1, including the operation of the blowing means 100, will be described.

When the user operates the operation panel 13 so as to turn the power on with the door 11 closed, prior to the heating of an article-to-be-heated 90 (see FIG. 4), preparatory operation as described earlier is performed to generate high-temperature steam with which to heat the article-to-be-heated 90. Simultaneously, the cooling fan 101 of the blowing means 100 is driven. This causes cooling air to be sucked in from outside the apparatus through the suction port 105 and introduced into the decoration box 102. The cooling air is then supplied, through the slits 102*b* of the decoration box 102, into the interior of the door 11 (into the gap between the individual transparent glass plates of the multiple-glazed portion 201), so that the door 11 is cooled.

In this state, when high-temperature steam suitable to heat an article-to-be-heated 90 is obtained, the generation of steam by the steam generating means is temporarily stopped, and the high-temperature steam inside the heating chamber 20 is exhausted through the exhaust port 32. Here, not all the steam can be immediately exhausted, and some steam remains inside the heating chamber 20 for a while. Meanwhile, under the control of the control device 80, the cooling fan 101 is kept being driven.

Figure 13:
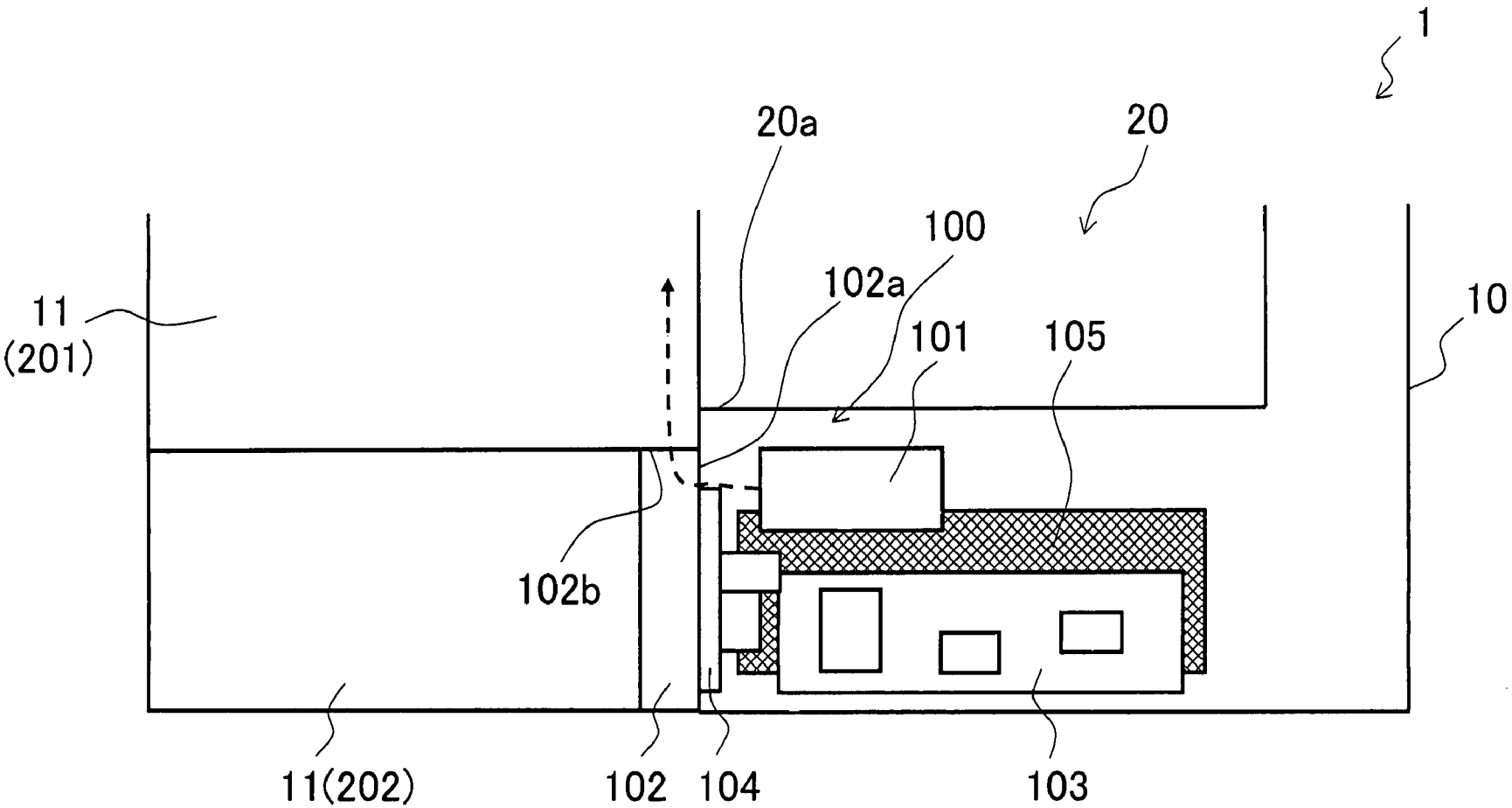
[FIG. 13] A horizontal cross-sectional view of the steam cooking apparatus, in a state with the door to the heating chamber opened.

Thus, in this state, with an attempt to put an article-to-be-heated 90 into the heating chamber 20, the user starts to open the door 11 as shown in FIG. 13, the cooling air sucked in by the cooling fan 101 and introduced into the decoration box 102 is blown through the slits 102*b* of the decoration box 102 to the opening 20*a* of the heating chamber 20 so that the cooling air passes sideways substantially across the opening 20*a*. The cooling air thus mixes with the high-temperature steam that tends to overflow frontward out of the heating chamber 20 as soon as the door 11 starts to be opened, and thereby lowers the temperature of the overflowing steam.

Subsequently, with the door 11 open, when the user puts an article-to-be-heated 90 into the heating chamber 20, closes the door 11, and operates the operation panel 13 so as to enter an instruction to heat the article-to-be-heated 90, then high-temperature steam starts to be jetted toward the article-to-be-heated 90. During the heat-cooking thus started, the cooling fan 101 is kept being driven. In this state, the cooling air sucked in by the cooling fan 101 is blown through the decoration box 102 into the interior of the door 11 so that the door 11 is cooled again (see FIG. 11).

On completion of heat-cooking, as described above, the generation of steam by the steam generating means is stopped and the high-temperature steam inside the heating chamber 20 is exhausted through the exhaust port 32, but, since not all the steam can be exhausted immediately, some high-temperature steam remains inside the heating chamber 20 for a while. Meanwhile, also here, under the control of the control device 80, the cooling fan 101 is kept being driven. Thus, with an attempt to take the article-to-be-heated 90 out of the heating chamber 20, the user starts to open the door 11, the cooling air sucked in by the cooling fan 101 is blown through the decoration box 102 to the opening 20*a* of the heating chamber 20 so that the cooling air passes sideways substantially across the opening 20*a* (see FIG. 13). The cooling air thus mixes with the high-temperature steam that tends to overflow frontward out of the heating chamber 20 as soon as the door 11 starts to be opened, and thereby lowers the temperature of the overflowing steam. After the door 11 is opened, under the control of the control device 80, the cooling fan 101 is kept being driven for a predetermined length of time, and then its operation is stopped.

As described above, the steam cooking apparatus 1 of this embodiment is provided with blowing means 100 that blows cooling air to the opening 20*a* of the heating chamber 20 when, after steam is supplied to the heating chamber 20 by the steam generating means, the door 11 starts to be opened. No matter whether before or after the heat-cooking of an article-to-be-heated 90, some high-temperature steam remains unexhausted inside the heating chamber 20. With the configuration described above, however, the cooling air mixes with the high-temperature steam that tends to overflow frontward as soon as the door 11 starts to be opened, and thereby lowers the temperature of the steam. Thus, it is possible to surely prevent the user from being hurt, as by being burnt, with the overflowing steam, and thus to ensure the safety of the user. Moreover, with this configuration, the door 11 can be opened immediately after completion of heat-cooking. This permits prompt transition thereafter to the following steps of food preparation, such as further processing and dishing-up of the article-to-be-heated 90 taken out of the heating chamber 20. Moreover, these benefits can be obtained without taking special measures, for example, to increase the exhaustion efficiency with which the steam inside the heating chamber is exhausted, and hence without the need for large-scale exhausting means leading to an undesirably large size of the apparatus as a whole and unduly high electric power consumption by it.

Moreover, in the configuration of this embodiment, where the door 11 opens at the top end thereof, the blowing means 100 blows the cooling air to the opening 20*a* of the heating chamber 20 so that the cooling air passes sideways, from right to left, substantially across the opening 20*a*. High-temperature steam is lighter than air and thus, when the door 11 starts to be opened, it tends to overflow frontward through an upper part of the opening 20*a*. As a result of the cooling air being blown sideways as described above, however, the path along which the steam flows out can be deviated in the direction in which the cooling air passes sideways. This prevents the steam from hitting the user standing in front of the apparatus, and thus helps realize an apparatus safer for the user to use.

Here, the slits 102*b* of the decoration box 102 of the blowing means 100 are provided above the height corresponding to half the vertical dimension of the opening 20*a* of the heating chamber 20, and thus the cooling air blown out through the slits 102*b* passes sideways substantially across an upper part of the opening 20*a* of the heating chamber 20 (a part higher than half the vertical dimension of the opening 20*a*). Considering that high-temperature steam is light and tends to overflow frontward through an upper part of the opening 20*a* when the door 11 starts to be opened, blowing the cooling air so that it passes sideways substantially across an upper part of the opening 20*a* helps satisfactorily obtain the benefit of deviating the steam outflow path in the direction in which the cooling air passes sideways.

Thus, with the configuration where the blowing means 100 blows cooling air to the opening 20*a* so that the cooling air passes sideways substantially across an upper part of the opening 20*a*, it is possible to efficiently obtain the benefit of ensuring the safety of the user by deviating the steam outflow passage in the cooling air's sideways passing direction. In particular, by letting the blowing means 100 blow the cooling air to the opening 20*a* so that the cooling air passes sideways substantially across a part of the opening 20*a* higher than half the vertical dimension thereof, it is possible to minimize the amount of cooling air blown and still obtain the above-mentioned benefits efficiently and surely. For example, the blowing means 100 may blow the cooling air to the opening 20*a* so that the cooling air passes sideways substantially across a part of the opening 20*a* higher than one-third down the vertical dimension of the opening 20*a* from the top thereof.

Moreover, in this embodiment, the blowing means 100 blows to the opening 20*a* of the heating chamber 20 the air sucked in from outside the apparatus by the cooling fan 101. In this way, the cooling fan 101 originally provided in the apparatus is used to cool the steam overflowing out of the heating chamber 20 through the opening 20*a*. This eliminates the need to separately provide cooling means dedicated to the cooling of the steam, and thus helps simplify the configuration of the apparatus and prevent it from becoming unduly large.

In addition, the air sucked in by the cooling fan 101 is deflected by the decoration box 102 serving as deflecting means and is then blown to the opening 20*a* of the heating chamber 20. This eliminates the need to pay special attention to where to arrange the cooling fan 101 (for example, where to change the position thereof), and helps surely secure the path along which to supply the cooling air to be blown to the opening 20*a*.

Moreover, the decoration box 102 directs the air sucked in by the cooling fan 101 toward a side of the multiple-glazed portion 201 when the door 11 is closed. Thus, when the door 11 starts to be opened, as shown in FIG. 13, the cooling air can surely be blown to the opening 20*a* of the heating chamber 20 so that the cooling air passes sideways substantially across the opening 20*a*. Moreover, when the door 11 is closed, the cooling air can be blown through the gap between the glass plates of the multiple-glazed portion 201. Thus, the door 1I can be cooled even during heat-cooking, when the door 11 remains closed.

Moreover, the decoration box 102 is so arranged as to be located, when the door 11 is closed, between the operation panel 13 provided on the support base plate 202 and the cabinet 10, at a side of the multiple-glazed portion 201. This helps keep the apparatus neat-looking when the door 11 is open. By giving the thus arranged decoration box 102 the function of serving as deflecting means for defecting the cooling air as described above, it is possible to eliminate the need to provide dedicated means for deflecting the cooling air, and thereby to reduce the number of components of the apparatus and simplify the configuration thereof, and also to effectively use the decoration box 102.

Moreover, in this embodiment, after completion of heat-cooking inside the heating chamber 20, after the door 11 starts to be opened, the blowing means 100 keeps driving the blowing means 100 for a predetermined length of time so that the cooling air is blown to the opening 20*a* of the heating chamber 20. Thus, it is possible to eliminate unnecessary operation of the cooling air being blown even after the steam overflowing through the opening 20*a* has been cooled, and thereby to prevent electric power from being unnecessarily consumed.

Moreover, in this embodiment, while steam is being supplied to the heating chamber by the heating medium generating means (steam generating means) (that is, during preparatory operation before heat-cooking or during heat-cooking itself), the blowing means 100 blows the cooling air into the interior of the door 11 in the closed state. Thus, even while the apparatus is operating, it is possible to prevent the temperature of the door from being unduly raised by the high-temperature steam inside the heating chamber, and thereby to ensure the safety of the user.

Figure 14:
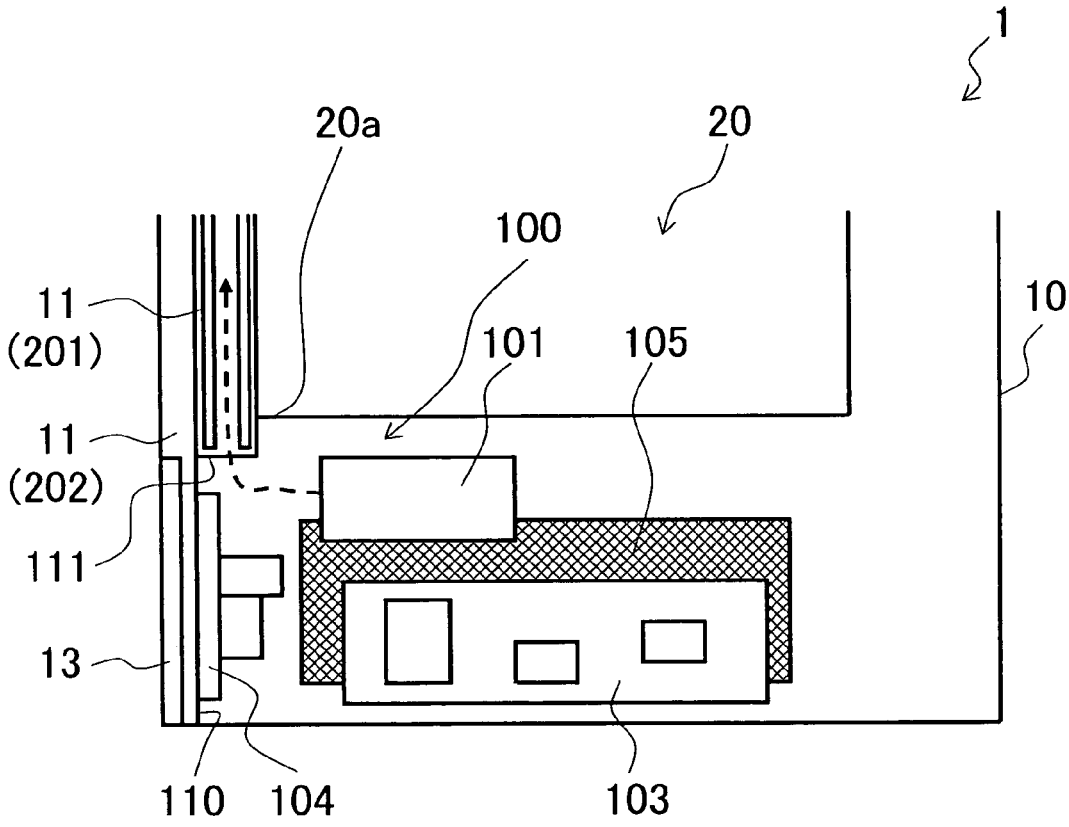
[FIG. 14] A horizontal cross-sectional view showing another construction of and around the door of the steam cooking apparatus.

The above description deals with a configuration where the decoration box 102 is arranged in a predetermined position on the front face of the cabinet 10. It should be understood, however, that the present invention may be practiced with the decoration box 102 arranged elsewhere. For example, as shown in FIG. 14, which is a horizontal cross-sectional view showing another construction of and around the door 11 of the steam cooking apparatus 1, in the steam cooking apparatus 1 here, a protruding portion 110 is formed on the cabinet 10 so as to protrude frontward along the surfaces of the multiple-glazed portion 201 and of the support base plate 202. This protruding portion 110 may be given the function of serving as the deflecting means described above.

Specifically, slits 111 may be provided in the face of the protruding portion 110 facing the multiple-glazed portion 201 when the door 11 is closed, at about the same height as the slits 102*b* of the decoration box 102, so that the air sucked in by the cooling fan 101 is, as cooling air, blown into the interior of the protruding portion 110 so as to be deflected to blow out of it through the slits 111 to eventually pass to the opening 20*a* of the heating chamber 20. Also with this configuration, the protruding portion 110 can be given the function of securing the path along which to supply the cooling air to be supplied to the opening 20*a*. Thus, the benefits of the present invention can equally be obtained as when the decoration box 102 is provided.

The embodiment described above deals with a steam cooking apparatus 1 where the door 11 opens at the top end thereof with respect to the opening 20*a*. It should be understood, however, that the present invention may be practiced with any other configuration. For example, the present invention, whereby cooling air is blown to the opening 20*a* when the door 11 is open, is applicable also in a steam cooking apparatus 1 where the door 11 is supported in a top part of the cabinet 10 for housing the heating chamber 20 so that the door 11 can be opened at the bottom end thereof with respect to the opening 20*a* in the front face of the heating chamber 20, and in a steam cooking apparatus 1 where a rectangular door 11 opens at the right side thereof about a vertical axis located on the left side. Here, doors 11 openable at the top end thereof and doors 11 openable at the bottom end thereof can collectively be called vertically openable doors.

The embodiment described above deals with a case where steam is used as the heating medium for heating the article-to-be-heated 90. It should be understood, however, that the present invention may be practiced otherwise. For example, also in a case where hot air is used as the heating medium and the hot air is circulated to heat an article-to-be-heated 90, when the door 11 is opened after completion of heat-cooking, as soon as it starts to be opened, the hot air overflows toward the user standing in front. By applying the present invention to such a hot-air-circulation-type heat-cooking apparatus, it is possible to obtain the benefits of the present invention, such as the benefit of preventing the user from being hurt.

The embodiment described above deals with a configuration where the steam generated by the steam generating means blows into the heating chamber 20 through the ceiling surface and two side surfaces of the heating chamber 20. It should be understood, however, that the present invention may be practiced with any other configuration. For example, the present invention may be applied also to configurations where steam is blown only through the ceiling surface of the heating chamber 20 or through the ceiling surface and one side surface thereof.

The embodiment described above deals with a configuration where the steam inside the heating chamber 20 is passed through the outer circulation passage 30 then through the sub-cavity 40 back to the heating chamber 20. It should be understood, however, that the present invention may be practiced with any other configuration. For example, the sub-cavity 40 may be supplied with new steam all the time while the steam overflowing out of the heating chamber 20 is kept exhausted through the steam exhaust pipe 47.

It should be understood that the present invention may be practiced with many other modifications and variations made within the scope thereof.

INDUSTRIAL APPLICABILITY

The present invention finds wide application in cooking apparatuses in general that perform cooking by use of overheated steam or hot air, no matter whether they are designed for household or business use.

The invention claimed is:

1. A heat-cooking apparatus comprising:

a heating chamber having an opening through which an article-to-be-heated is put into and taken out of the heating chamber;

a door which is pivotably hinged in a bottom part or top part of a casing for housing the heating chamber and with which the opening is opened and closed; and a heating medium generating unit for generating a heating medium, the heat-cooking apparatus heating and thereby cooking the article-to-be-heated placed inside the heating chamber by means of the heating medium, wherein the heat-cooking apparatus further comprises:

a blowing unit that blows air so that the air passes the opening sideways through ports located above a center of the opening and parallel to a rotation axis of the door when the door is opened, and the blowing unit blowing the air only across a part of the opening substantially above a center thereof.

2. The heat-cooking apparatus of claim 1, wherein the heating medium generating unit is a steam generating unit that generates steam as the heating medium.

3. The heat-cooking apparatus of claim 1, wherein the opening is provided in a front face of the heating chamber, the door is pivotably hinged in a bottom part or top part of a casing for housing the heating chamber so that the door opens vertically with respect to the opening.

4. The heat-cooking apparatus of claim 1, wherein the blowing unit blows the air to the opening so that the air passes an upper part of the opening sideways.

5. The heat-cooking apparatus of claim 4, wherein the blowing unit blows the air to the opening so that the air passes a part of the opening above half a vertical dimension thereof sideways.

6. The heat-cooking apparatus of claim 1, wherein the blowing unit has a cooling fan for cooling a power supply circuit board provided inside the apparatus, and the blowing unit blows, air sucked in from outside the apparatus by the cooling fan so that air passes the opening sideways.

7. The heat-cooking apparatus of claim 6, wherein the blowing unit includes a deflecting unit that deflects the air sucked in by the cooling fan to blow the air so that air passes the opening sideways.

8. The heat-cooking apparatus of claim 7, wherein the door has a multiple-glazed portion having a plurality of transparent glass plates arranged to face one another at a predetermined gap from one another so that, when the door is closed, part of the multiple-glazed portion faces at least the opening, and the deflecting unit directs the air sucked in by the cooling fan toward a side of the multiple-glazed portion when the door is closed.

9. The heat-cooking apparatus of claim 8, wherein the door has a support base plate that has an area larger than an area of the multiple-glazed portion and so large as to cover an entire opening-side face of the heating chamber in the casing and that supports the multiple-glazed portion from a face thereof facing away from the opening when the door is closed, the support base plate includes an operation portion for setting operation conditions of the apparatus, and the deflecting unit is built with a decoration box that is provided between the operation portion and the casing, at a side of the multiple-glazed portion when the door is closed.

10. The heat-cooking apparatus of claim 8, wherein the door has a support base plate that has an area larger than an area of the multiple-glazed portion and so large as to cover an entire opening-side face of the heating chamber in the casing and that supports the multiple-glazed portion from a face thereof facing away from the opening when the door is closed, the support base plate includes an operation portion for setting operation conditions of the apparatus, and the deflecting unit is built with a protruding portion that protrudes from the casing along surfaces of the multiple-glazed portion and of the support base plate when the door is closed.

11. The heat-cooking apparatus of claim 1, wherein the blowing unit blows the air so that the air passes the opening sideways for a predetermined length of time after the door is opened after completion of heat-cooking inside the heating chamber.

12. The heat-cooking apparatus of claim 1, wherein while the heating medium is being supplied to the heating chamber by the heating medium generating unit, the blowing unit blows the air into an interior of the door in a closed state.

13. The heat-cooking apparatus of claim 1, wherein the blowing unit blows the air so that the air passes the opening sideways in front thereof.

14. A heat-cooking apparatus comprising:

a heating chamber having an opening through which an article-to-be-heated is put into and taken out of the heating chamber;

a door which is pivotably hinged in a bottom part or top part of a casing for housing the heating chamber and with which the opening is opened and closed; and a heating medium generating unit for generating a heating medium, the heat-cooking apparatus heating and thereby cooking the article-to-be-heated placed inside the heating chamber by means of the heating medium, wherein the heat-cooking apparatus further comprises:

a blowing unit that blows air so that the air passes the opening sideways and parallel to a rotation axis of the door when the door is opened; and a slit located above a center of the opening that is provided at a side of the opening and through which the air blown by the blowing unit is blown out, when the door is opened, an air curtain is formed in front of the opening by the air blown out through the slit, and the blowing unit blowing the air only across a part of the opening substantially above a center thereof.

15. The heat-cooking apparatus of claim 14, wherein the slit is provided in an upper portion of the side of the opening.

16. The heat-cooking apparatus of claim 1, further comprising:

an exhausting unit that, with opening operation of the door, exhausts the heating medium inside the heating chamber to outside the heat-cooking apparatus.

17. The heat-cooking apparatus of claim 14, further comprising:

an exhausting unit that, with opening operation of the door, exhausts the heating medium inside the heating chamber to outside the heat-cooking apparatus.

18. A heat-cooking apparatus comprising:

a heating chamber having an opening through which an article-to-be-heated is put into and taken out of the heating chamber;

a door which is pivotably hinged in a bottom part or top part of a casing for housing the heating chamber and with which the opening is opened and closed;

a heating medium generating unit generating a heating medium, and an exhausting unit that exhausts the heating medium inside the heating chamber, the heat-cooking apparatus heating and thereby cooking the article-to-be-heated placed inside the heating chamber by means of the heating medium, wherein the heat-cooking apparatus further comprises:

a blowing unit that blows air to the opening, and with opening operation of the door, the blowing unit blows out the air to the opening so that the air passes the opening sideways through ports located above a center of the opening and parallel to a rotation axis of the door, the blowing unit blowing the air only across a part of the opening substantially above a center thereof, and the exhausting unit exhausts the heating medium inside the heating chamber.

19. The heat-cooking apparatus of claim 18, wherein the exhausting unit is provided on a side wall of the heating chamber.

20. A heat-cooking apparatus comprising:

a heating chamber having an opening through which an article-to-be-heated is put into and taken out of the heating chamber;

a door which is pivotably hinged in a bottom part or top part of a casing for housing the heating chamber and with which the opening is opened and closed; and a heating medium generating unit generating a heating medium, the heat-cooking apparatus heating and thereby cooking the article-to-be-heated placed inside the heating chamber by means of the heating medium, wherein the heat-cooking apparatus further comprises:

a blowing unit that blows air so that the air passes the opening sideways and parallel to a rotation axis of the door when the door is opened; and a slit located above a center of the opening that is provided at a side of the opening and through which the air blown by the blowing unit is blown out, and both before and after the door is opened, the air is blown out through said same slit to in front of the opening so that the air passes only across a part of the opening substantially above a center thereof.

21. A heat-cooking apparatus comprising:

a heating chamber having an opening through which an article-to-be-heated is put into and taken out of the heating chamber;

a door which is pivotably hinged in a bottom part or top part of a casing for housing the heating chamber and with which the opening is opened and closed; and a heating medium generating unit generating a heating medium, the heat-cooking apparatus heating and thereby cooking the article-to-be-heated placed inside the heating chamber by means of the heating medium, wherein the heat-cooking apparatus further comprises:

a blowing unit that blows air so that the air passes the opening sideways and parallel to a rotation axis of the door when the door is opened; and a slit located above a center of the opening that is provided at a side of the opening and through which the air blown by the blowing unit is blown out, and before and after the door is opened, the air is blown out through said same slit so that, when the door is closed, the air is blown out into an interior of the door and, when the door is open, the air is blown out so that the air passes only across a part of the opening substantially above a center thereof.

22. A heat-cooking apparatus comprising:

a heating chamber having an opening through which an article-to-be-heated is put into and taken out of the heating chamber;

a door which is pivotably hinged in a bottom part or top part of a casing for housing the heating chamber and with which the opening is opened and closed; and a heating medium generating unit for generating a heating medium, the heat-cooking apparatus heating and thereby cooking the article-to-be-heated placed inside the heating chamber by means of the heating medium, wherein the heat-cooking apparatus further comprises:

a blowing unit that blows out air so that the air passes the opening sideways through ports located above a center of the opening and parallel to a rotation axis of the door before and after the door is opened, and the blowing unit blowing the air only across a part of the opening substantially above a center thereof.

23. The heat-cooking apparatus of claim 22, wherein the blowing unit blows out the air so that the air passes the opening sideways in front thereof before and after the door is opened.

* * * * *